US008105009B1

(12) United States Patent
Harper et al.

(10) Patent No.: US 8,105,009 B1
(45) Date of Patent: Jan. 31, 2012

(54) ECONO-OPTIMIZED BOARD EDGER

(75) Inventors: Jeff Harper, Ruston, LA (US); Wayne Parks, Dubach, LA (US); Jeremy S. Clark, Ruston, LA (US); Anthony G. Clark, Ruston, LA (US); Clyde Stearns, Mukilteo, WA (US); Mark Burns, Ruston, LA (US); Brian Wallace Smith, Ohauiti (NZ); John Grubbs, Brandon, MS (US); Donald Haley, Monroe, LA (US)

(73) Assignee: WPS Industries, Inc., West Monroe, LA (US)

( * ) Notice: Subject to any disclaimer, the term of this patent is extended or adjusted under 35 U.S.C. 154(b) by 857 days.

(21) Appl. No.: 12/117,276

(22) Filed: May 8, 2008

Related U.S. Application Data

(60) Provisional application No. 60/916,702, filed on May 8, 2007.

(51) Int. Cl.

| | |
|---|---|
| ***B66F 11/00*** | (2006.01) |
| ***B27B 31/00*** | (2006.01) |
| ***B27G 21/00*** | (2006.01) |
| ***B23Q 16/00*** | (2006.01) |
| ***B65G 47/26*** | (2006.01) |

(52) U.S. Cl. ..... 414/746.3; 144/245.2; 144/357; 198/456

(58) Field of Classification Search ..... 144/245.2, 144/245.3, 250.13, 250.14, 250.16; 198/345.1, 198/370.02, 375, 456, 502.2, 717; 414/15–16, 414/745.1, 745.7, 746.1, 746.2, 746.3, 746.4, 414/746.7, 780, 781, 783

See application file for complete search history.

(56) References Cited

U.S. PATENT DOCUMENTS

| | | | | |
|---|---|---|---|---|
| 3,806,253 | A * | 4/1974 | Denton | 356/601 |
| 3,931,501 | A | 1/1976 | Barr et al. | |
| 4,106,538 | A * | 8/1978 | Sigfridsson et al. | 144/376 |
| 4,383,561 | A * | 5/1983 | Gregoire et al. | 144/245.2 |
| 4,386,641 | A * | 6/1983 | Horn | 144/329 |
| 4,462,443 | A * | 7/1984 | Allen | 144/245.1 |
| 4,879,752 | A | 11/1989 | Aune et al. | |
| 5,028,202 | A * | 7/1991 | Katada et al. | 414/783 |
| 5,368,080 | A * | 11/1994 | Hamel | 144/357 |
| 5,429,161 | A * | 7/1995 | Allard | 144/248.4 |
| 5,918,653 | A * | 7/1999 | Knerr | 144/404 |
| 7,007,729 | B1 * | 3/2006 | Landers | 144/242.1 |

FOREIGN PATENT DOCUMENTS

| | | |
|---|---|---|
| CA | 1125148 | 6/1982 |
| CA | 1146051 | 5/1983 |

OTHER PUBLICATIONS

Scott A Bowe, Robert L. Smith, D. Earl Kline, Philip A. Araman; "A Segmental Analysis of Current and Future Scanning and Optimizing Technology in the Hardwood Sawmill Industry", Forest Products Journal, vol. 52, No. 3, Mar. 2002, pp. 68-76.

* cited by examiner

*Primary Examiner* — Gregory Adams
(74) *Attorney, Agent, or Firm* — Jones, Walker, Waechter, Poitevent, Carrere & Denegre L.L.P.

(57) ABSTRACT

A method of positioning lumber in a given orientation in a handling apparatus having a base frame, a longitudinal transport assembly, and at least two gripper arm support platforms with a pair of gripper arms positioned on each of the support platforms. A work piece is gripped with the gripper arms without the work piece engaging the longitudinal transport assembly. The gripper arms are adjusted on at least one of the support platforms in a direction generally perpendicular to the longitudinal transport assembly in order to selectively position the work piece. The work piece is then brought into engagement with the transport assembly and the gripper arms are released from the work piece.

10 Claims, 31 Drawing Sheets

ECONO-OPTIMIZED BOARD EDGER

This application claims the benefit under 35 USC §119(e) of U.S. provisional application No. 60/916,702 filed May 8, 2007, which is incorporated by reference herein in its entirety.

FIELD OF INVENTION

The disclosed embodiments of the present invention relate to methods and apparatuses for positioning an item. In particular, the disclosed embodiments relate to positioning a piece of lumber prior to the lumber entering a sawing station.

BACKGROUND OF INVENTION

In the lumber industry, boards are typically created through multiple sawing steps. A relative cylindrical or conical log will first be sawed length-wise to create unfinished planks or "flitches" which have a uniform thickness, but whose opposing edges ("wanes") are still uncut and therefore non-uniform. To create a board with constant width (i.e., uniform edges), a second sawing step is performed which cuts away a predetermined amount of the wanes. In order to optimize the amount of lumber obtained from each unfinished flitch, the flitch should enter the second sawing step at a certain orientation, typically in terms of the relationship between the centerlines of the flitch and the sawing apparatus.

Typically the unfinished flitches are fed along a conveyance system to a saw station to accomplish this second sawing step. The conveyance system may comprise a belt, chain, or a series of rollers on which the flitch rests and which moves the flitch toward the sawing station. The conveyance system may also include a series of side rollers to prevent the flitch from moving laterally as it engages the saw blades in the saw station. In some instances, the side rollers may be independently adjustable to impart specific orientations on the flitch.

Techniques are also known in which the wanes of a flitch are sensed or measured by an optical or mechanical measuring system. These measurement results are fed to a computer system programmed to calculate the orientation of the flitch relative to the saws which will provide the optimal cutting solution. These systems can then produce control signals which will automatically position the side rollers or other alignment devices such that the flitch assumes the optimal cutting orientation. Despite advances in sawing techniques such as described above, there still exists the need for improve methods and apparatuses for accurately and reliably positioning flitches (or any other items or work pieces) as those items travel along a conveyance system.

SUMMARY OF SELECTED EMBODIMENTS OF INVENTION

One embodiment provides a lumber handling apparatus which includes a base frame having a longitudinal transport assembly with at least two gripper arm support platforms positioned on the base frame. A skewing assembly operates on each support platform in order to move the support platform at least laterally with respect to the base frame. Furthermore, at least two gripper arms are positioned on each of the support platforms such that the gripper arms are capable of moving toward and away from the longitudinal transport assembly to provide gripping and release positions. Still further, there is a hold-down assembly which is capable of securing an item of lumber against the longitudinal transport assembly when the gripping arms are in either the gripping position or the release position.

Another embodiment provides a method of positioning lumber in a given orientation in a base frame, a longitudinal transport assembly, and at least two gripper arm support platforms with a pair of gripper arms positioned on each of the support platforms. A work piece is gripped with the gripper arms without the work piece engaging the longitudinal transport assembly. The gripper arms are adjusted on at least one of the support platforms in a direction generally perpendicular to the longitudinal transport assembly in order to selectively position the work piece. The work piece is then brought into engagement with the transport assembly and the gripper arms are released from the work piece.

A further embodiment provides a method in a handling apparatus comprising a base frame, a longitudinal transport assembly, and at least two gripper arm support platforms with a pair of gripper arms positioned on each of the support platforms. The gripper arms grip the work piece over the longitudinal transport assembly and an image of the work piece is made. A recommended orientation is calculated based on the image and at least one of the gripper arms is adjusted based upon the recommended orientation. Then the work piece is then engaged by the longitudinal transport assembly while maintaining the recommended orientation.

DETAILED DESCRIPTION OF SELECTED EMBODIMENTS

Figure 1:
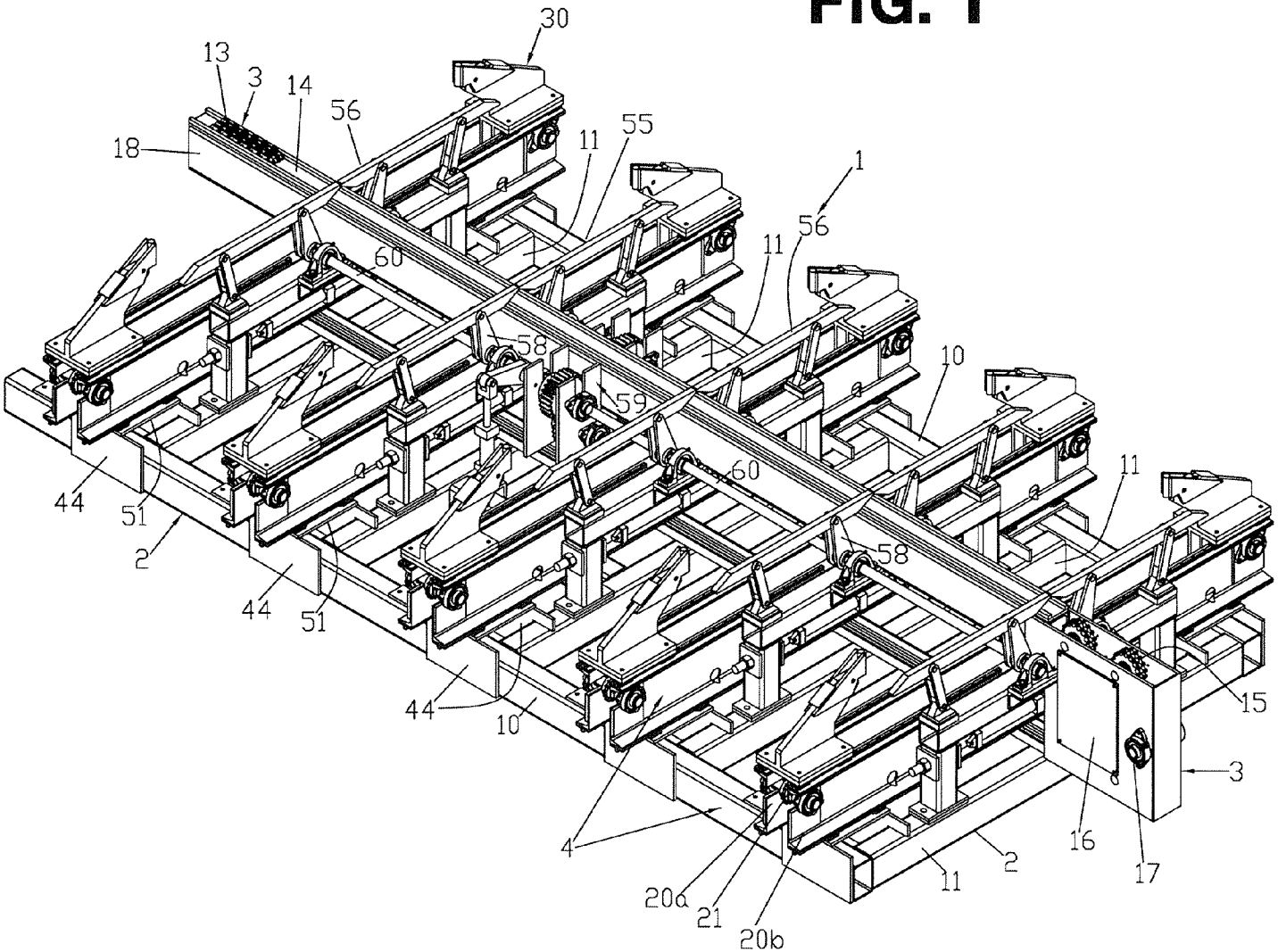
FIG. 1 is a perspective view of one embodiment of the present invention.

FIG. 1 illustrates one embodiment of the present invention, handling apparatus 1. In certain embodiments, handling apparatus 1 may be intended to process unfinished flitches, lengths of lumber or some other item of wood. However, other embodiments may process various types of work pieces, regardless of shape or whether made of wood or some other material.

The embodiment of handling apparatus 1 seen in FIG. 1 generally comprises a base frame 2, gripper arm support platforms 4, gripper arms 30, lift arm assemblies 55 and longitudinal transport assembly 3. Base frame 2 includes at least two longitudinal frame members 10 and a series of lateral frame members 11 positioned between longitudinal frame members 10. In the embodiment shown, longitudinal frame members 10 and lateral frame members 11 are tubular steel beams and may be connected by any existing or future developed means, including welding and/or bolting.

Figure 5B:
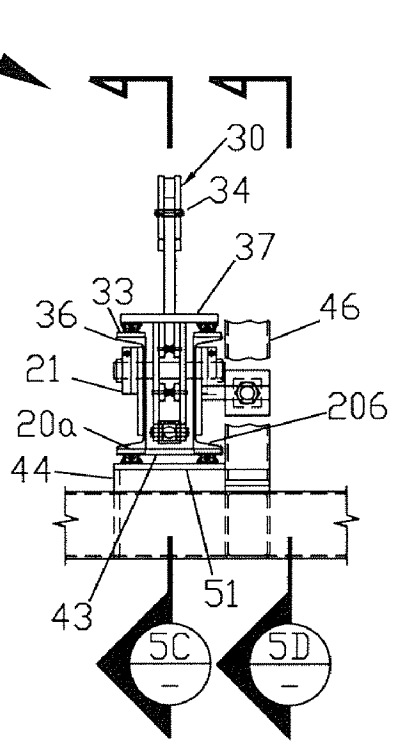
FIGS. 5A to 5D illustrate views of one embodiment of the gripper arms and skewing assembly of the present invention.
Figure 5A:
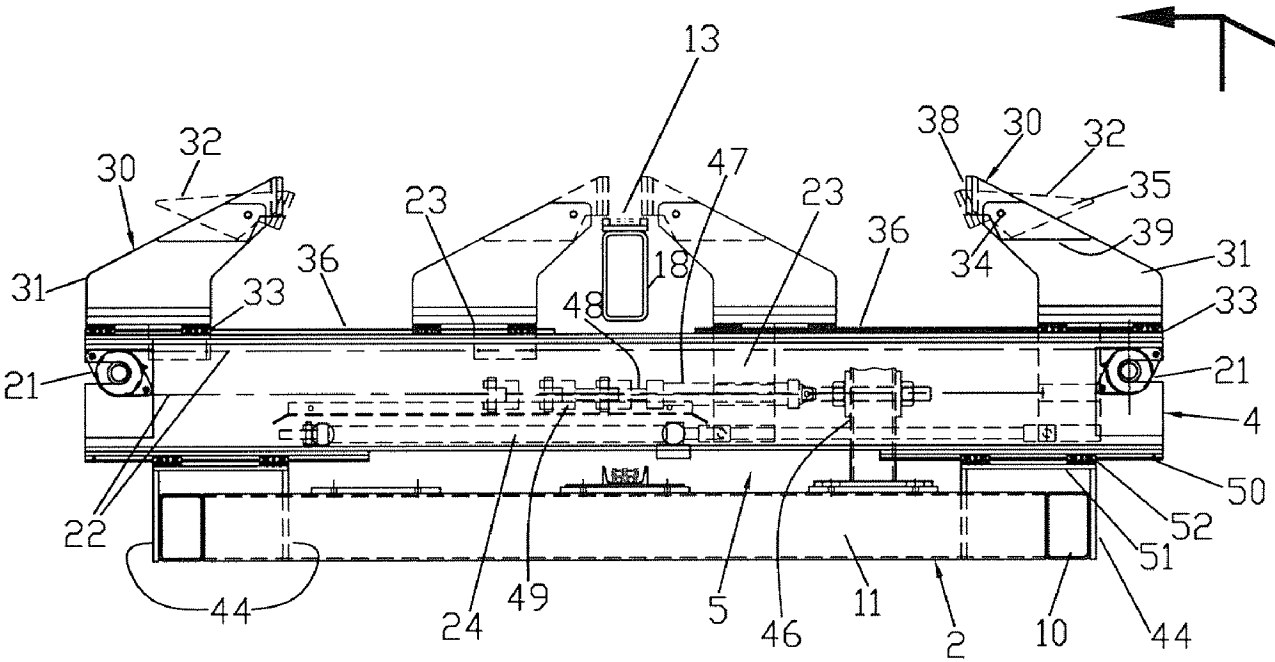

Positioned across longitudinal frame members 10 are a plurality of gripper arm support platforms 4. As best seen in FIGS. 5A and 5B, gripper arm support platforms 4 are situated above longitudinal frame members 10 and lateral frame members 11 by resting on platform plates 51, which in turn are secured to longitudinal frame member 10 and lateral frame members 11 by a series of connector plates 44. FIG. 5B illustrates how in this embodiment, the main structure of gripper arm support platforms 4 are constructed of two channel beams 20*a* and 20*b* spaced apart and joined at their bottom by connector plate 43. The top surface of platform plates 51 will have platform rollers 52 attached thereto. Of course, gripper arm support platforms 4 are not limited to the structure seen in the Figures and any structure which allows movement of gripper arms 30 (described below) may function as support platforms 4.

It will be understood that gripper arm support platforms 4 may move laterally to the left and right (as seen in FIG. 5A) since the bottom flanges of channel beams 20*a* and 20*b* (and particularly roller surface 50) rest on platform rollers 52 and may roll thereon. This "skewing" or lateral movement of gripper arm support platforms 4 may be controlled by skewing assembly 5 which includes in one embodiment skewing cylinder 47. The hydraulic piston and cylinder assembly (or simply "cylinder" herein) 47 seen in FIGS. 5A and 5B is attached at one end to skewing post 46 and at the other end (the piston rod end) to channel beam 20*b* by way of coupler 49. FIG. 5D shows how in this embodiment, coupler 49 connects to an attachment plate 53 which is fixed to channel beam 20*b* (although skewing post 46 is removed for clarity). As seen in FIG. 5A, skewing posts 46 are fixed to lateral frame members 11. Thus, when the piston rod 48 of skewing cylinder 47 is extended or retracted, it will cause channel beams 20*a* and 20*b* to move left and right on rollers 52. As explained in more detail below, this allows gripper arms 30 to be skewed left or right after they have gripped a work piece. It will be understood that the Figures illustrate simply one possible method for skewing gripper arm support platforms 4. Any method or apparatus for causing relative movement between support platforms 4 and the base frame should be considered a "skewing assembly" as used herein. Nor is the actual structure to the skewing assembly is mounted or attached critical and may vary from embodiment to embodiment.

Still viewing FIGS. 5A and 5B, a pair of gripper arms 30 are positioned on gripper arm support platforms 4. FIG. 5A illustrates gripper arms 30 in two different positions, a closed position next to sharp chain 13 and an open position at the left and right edges of gripper arm support platform 4. In the embodiment shown, each gripper arm 30 comprises a gripper base plate 37, a gripper neck 31 extending upward therefrom, and a gripper dog 32 attached to gripper neck 31. Gripper dog 32 is pivotally mounted on gripper neck 31 so that it may freely rotate forward on pin 34 as suggested by the two positions of gripper dog 32 seen in FIG. 5A. Gripper dog 32 further includes a gripping surface 38 and a weighted rear section 35 which positions the center of gravity of gripper dog 32 to the rear (i.e., to the right of the right gripper dog 32 in FIG. 5A) of pivot pin 34. This rearward center of gravity ensures that gripper dog 32 is biased in the gripping position (i.e., with gripping surfaces 38 in the upright gripping position seen in the center of FIG. 5A). A stop plate 39 limits the downward movement of rear section 35 so the gripper dogs 32 normally rest in the upright gripping position. Gripper dog 32 could take many alternate shapes and designs from those shown in the Figures as long as the alternative gripper dog design could generally carry out the functions described herein.

Figure 5C:
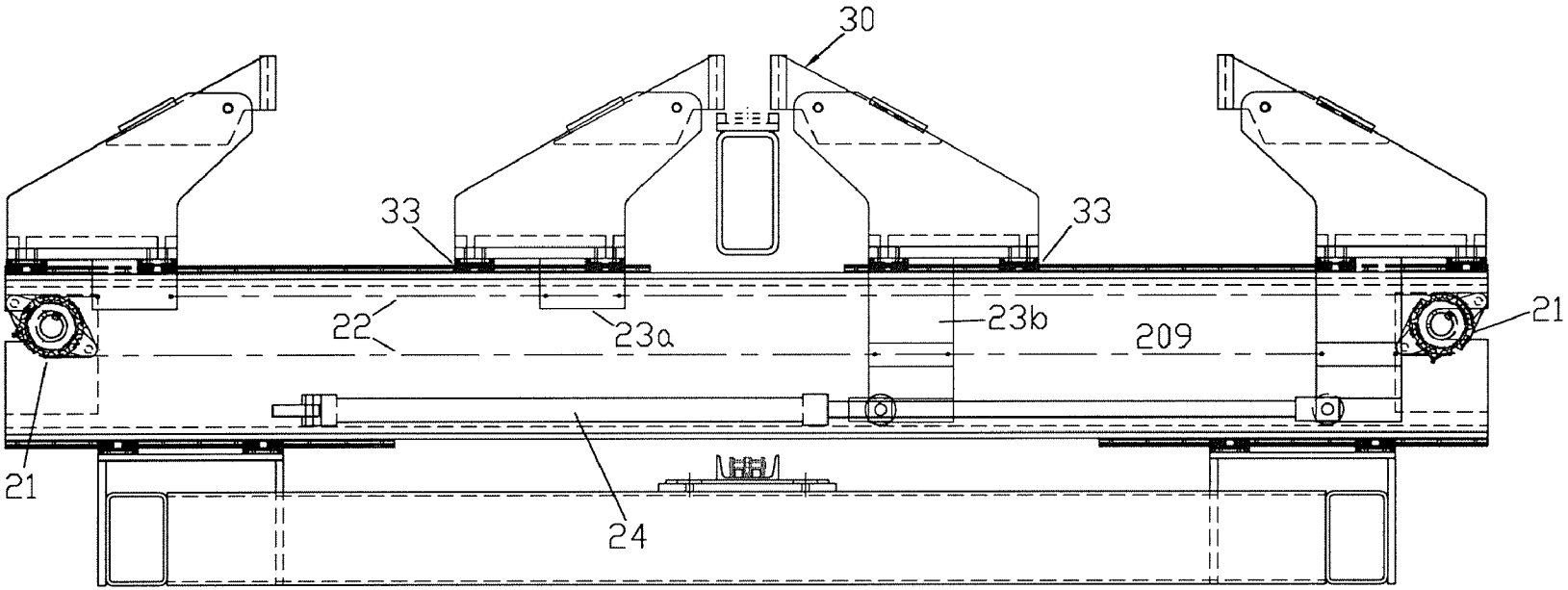
Figure 5D:
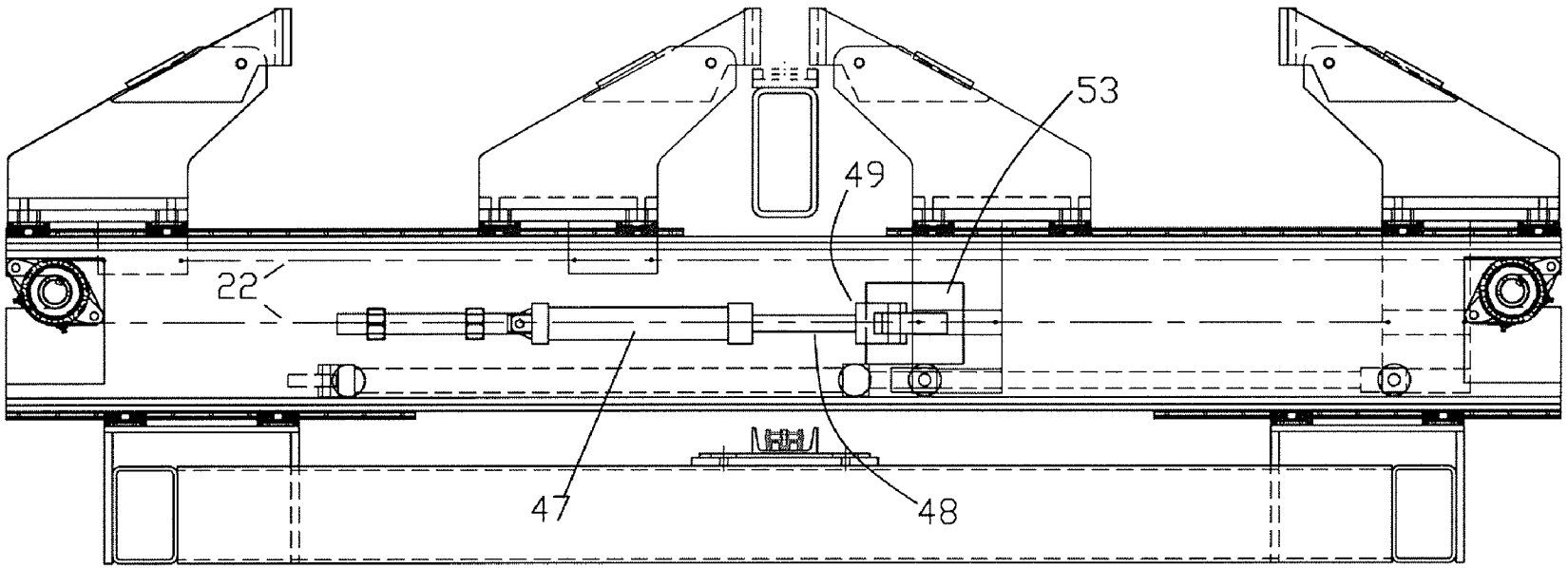

The opening and closing of gripper arms 30 between the two positions seen in FIG. 5C may be accomplished by any currently existing or future developed means. In the embodiments shown, connector plates 23 are attached to the lower portion of gripper arms 30. In this example, a short connector plate 23*a* attaches to the left gripper arm 30 and a longer connector plate 23*b* attaches to the right gripper arm 30. A continuous activation chain 22 attaches to connector plate 23*a*, passes through the first sprocket 21, attaches to connector plate 23*b*, passes through the second sprocket 21, and attaches again to connector plate 23*a*. An activation piston and cylinder assembly 24 will be connected at its cylinder end to channel beam 20*a* and at its piston arm end to connector plate 23*b*. It can be seen how extension of the piston arm from cylinder 24 will cause the right gripper arm 30 to move to its far right position. At the same time, the tension produced in chain 22 will act to pull connector plate 23*a* (and thus the left gripper arm 30) leftward to the far left. From this arrangement, it will be apparent that the retracting and extending of the piston arm of cylinder 24 will cause gripper arms 30 to move between their open and closed positions. The connection of plates 23 along the length of activation chain 22 is spaced such that each gripper arm 30 maintains the same distance from sharp chain 13 as gripper arms 30 close, thereby ensuring that the work piece gripped by gripper arms 30 will be centered over sharp chain 13. However, the exact centering of a work piece over sharp chain 13 is not necessarily required for all embodiments and variations in the positioning of a work piece are within the scope of the present invention.

Figure 6:
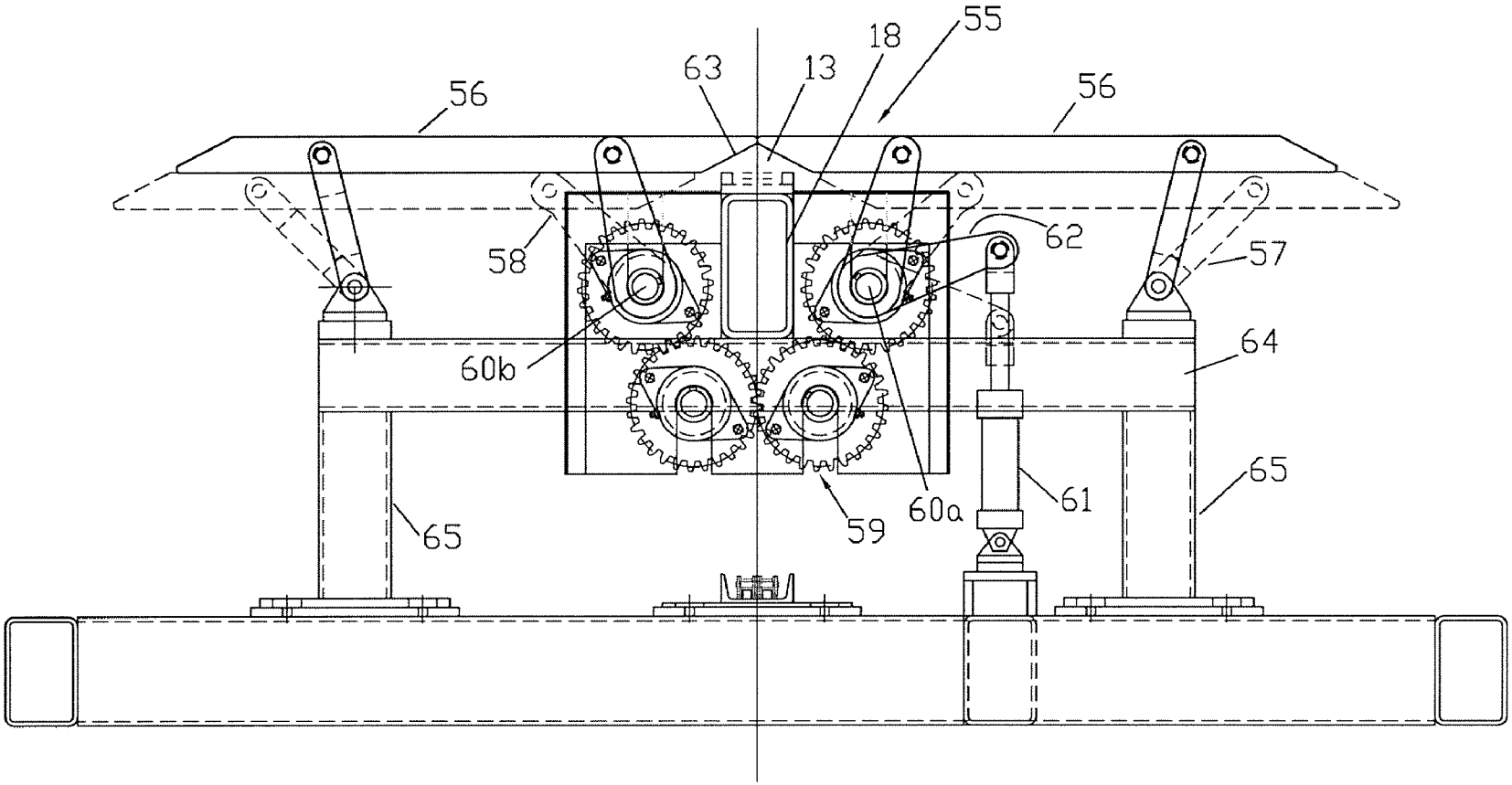
FIG. 6 is an end view illustrating one embodiment of the lift arms which could be employed in the present invention.

Returning to FIG. 1, another component of handling apparatus 1 is lift arm assembly 55. As better seen in FIG. 6, the illustrated embodiment of lift arm assembly 55 includes two lift arms 56. These lift arms 56 are comparatively narrow bars having a rectangular cross section. In FIG. 6, the lift arms 56 have an angled tip 63 which provides clearance for sharp chain 13 (explained below). Lift arms 56 will be supported above sharp chain 13 by a lateral beam 64 positioned on two vertical posts 65. In the embodiment of FIG. 1, post 46 to which skewing cylinder 47 is attached may act as one vertical post 65. A pivot linkage 57 is pinned on one end near the junction of beam 64 and post 65. The other end of pivot linkage 57 is pinned toward the end of lift arm 56 which is distal from sharp chain 13. Similarly, one end of a lifting linkage 58 is pinned toward the end of lift arm 56 which is proximal sharp chain 13. The other end of lifting linkage 58 is fixed on a common drive shaft 60 (see FIG. 1). Torque will be supplied to common drive shaft 60 by a set of drive gears 59. The embodiment of FIG. 6 illustrates how a power linkage 62 will be connected between a power piston 61 and one of the power shafts 60. It can be seen that rotation of the drive gear 59 attached to power shaft 60*a* will cause rotation of the other drive gears 59 and hence the opposite shaft 60*b*. FIG. 6 illustrates how lift arms 56 will move between an upper and lower position by the rotation of drive gears 59 caused by power cylinder 61 acting upon power linkage 62. As explained in more detail below, in the upper position lift arms 56 will bridge and support a piece of lumber above sharp chain 13. In the lower position, lift arms 56 will drop below the level of sharp chain 13 so that it may engage the item previously held over it by lift arms 56 when in the upper position. In the embodiment of FIG. 1, it can be seen that one set of drive gears 59 operate the common drive shafts 60 (one of which is hidden from view).

Figure 4:
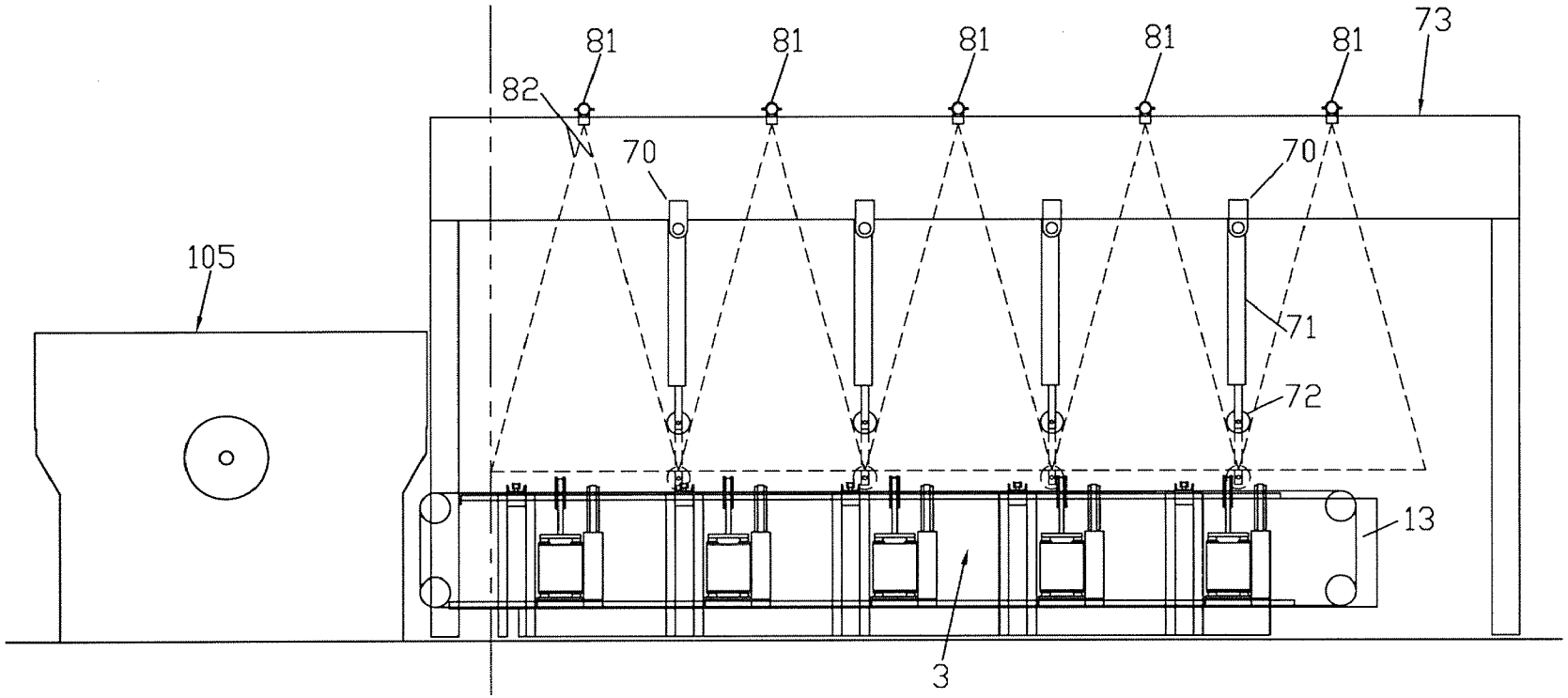
FIG. 4 side schematic view of one embodiment of a hold-down assembly which could be employed in the present invention.

A further element of the illustrated embodiments is longitudinal transport assembly 3 (FIG. 1). In the embodiments shown, longitudinal transport assembly 3 includes sharp chain 13. While only a short section of sharp chain 13 is seen in FIG. 1, FIG. 4 demonstrates how sharp chain 13 will run in a continuous loop along the top of handling apparatus 1 and return along its lower portions. It will be understood that sharp chain 13 has sharp upstanding projections which penetrate the surface of a section of lumber positioned on sharp chain 13. Viewing FIG. 1, it can be seen how sharp chain 13 travels in chain track 14 positioned on track beam 18. Sharp chain 13 will be driven by chain sprockets 15 which are positioned within gear box 16 (the chain sprockets 15 are omitted on the left side of FIG. 1 to simplify the view). Any conventional source of torque will engage power input 17, transferring torque to drive sprockets 15 and causing the rotation of sharp chain 13. One acceptable sharp chain 13 for use in the present invention is provided by Can-Am Chains of Surrey, British Columbia under model no. 80-2-4 PEP. FIG. 4 also illustrates how a conventional sawing station 105 will be positioned at the end of longitudinal transport assembly 3. In one embodiment, sawing station 105 may be an Optimizer Edger provided by Crosby Sawmill Machines of Simsboro, La.

In addition to sharp chain 13, the embodiment of longitudinal transport assembly seen in the Figures includes hold-down assembly 70 best seen in FIG. 4. An overhead frame 73 is positioned over sharp chain 13 and a series of linear actuators (e.g., pneumatic hold-down piston and cylinder assemblies 71) are suspended from over head frame 73 and maintained in position (i.e., against rotation toward saw station 105) with sheer bolts. Each hold-down cylinder 71 will have a roller 72 positioned on the end of the piston arm. As suggested in FIGS. 9 and 10, roller 72 may be retracted above a flitch positioned over sharp chain 13 (FIG. 9) or may be extended downward to capture a flitch between roller 72 and sharp chain 13 (see FIG. 10). When the rollers 72 are in the lower capture position, it will be understood that rollers 72 hold the flitch against sharp chain 13, but allow the flitch to move in sharp chain 13's direction of travel. The sheer bolts are designed to fail and prevent bending damage to the piston and cylinder assemblies should the rollers 72 be accidently lowered in front of the flitch and forced toward the saw station by the flitch's front edge.

Figure 2:
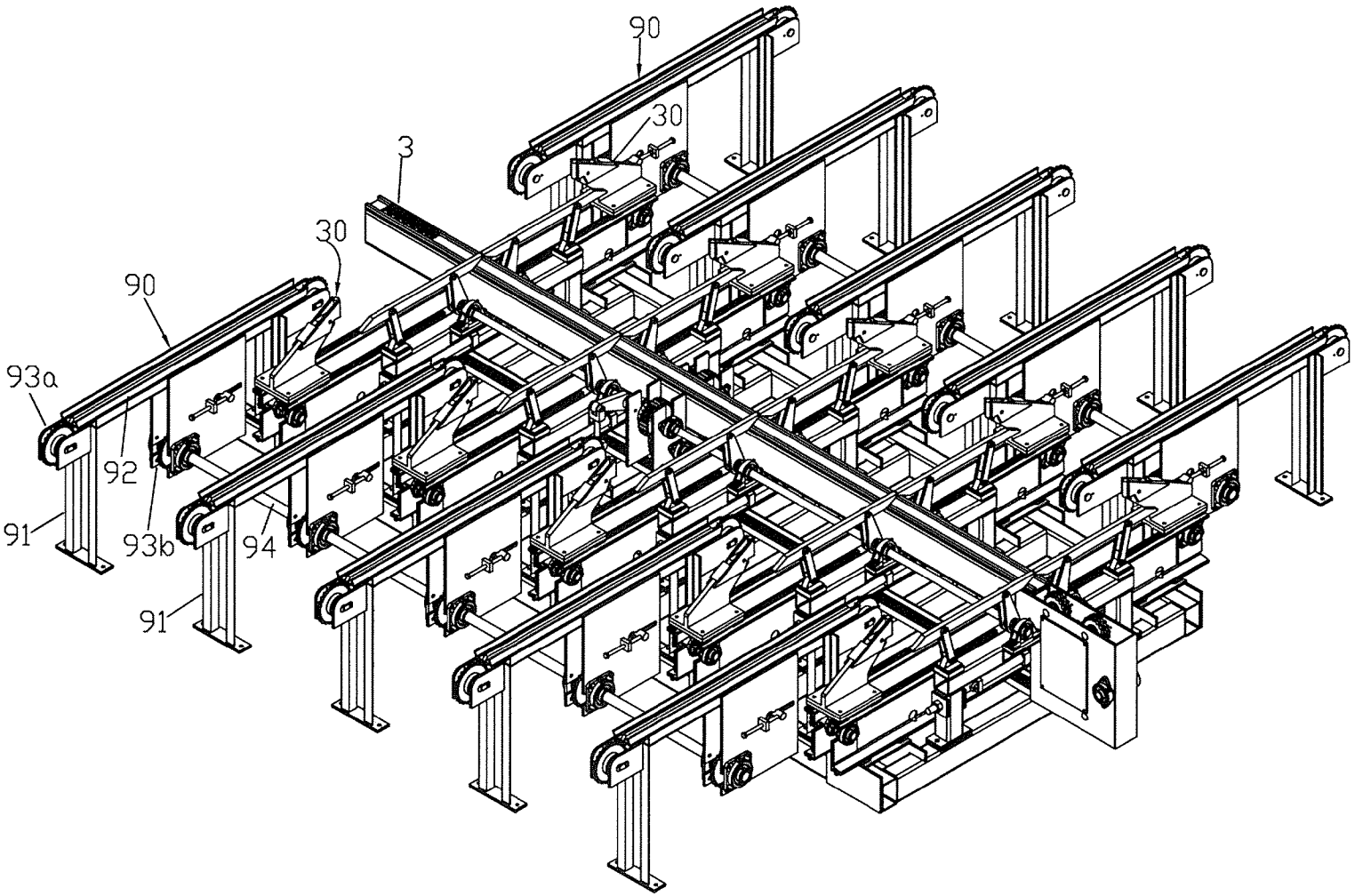
FIG. 2 is a perspective view further illustrating one type of lateral feed mechanism which could be employed in the present invention.
Figure 3:
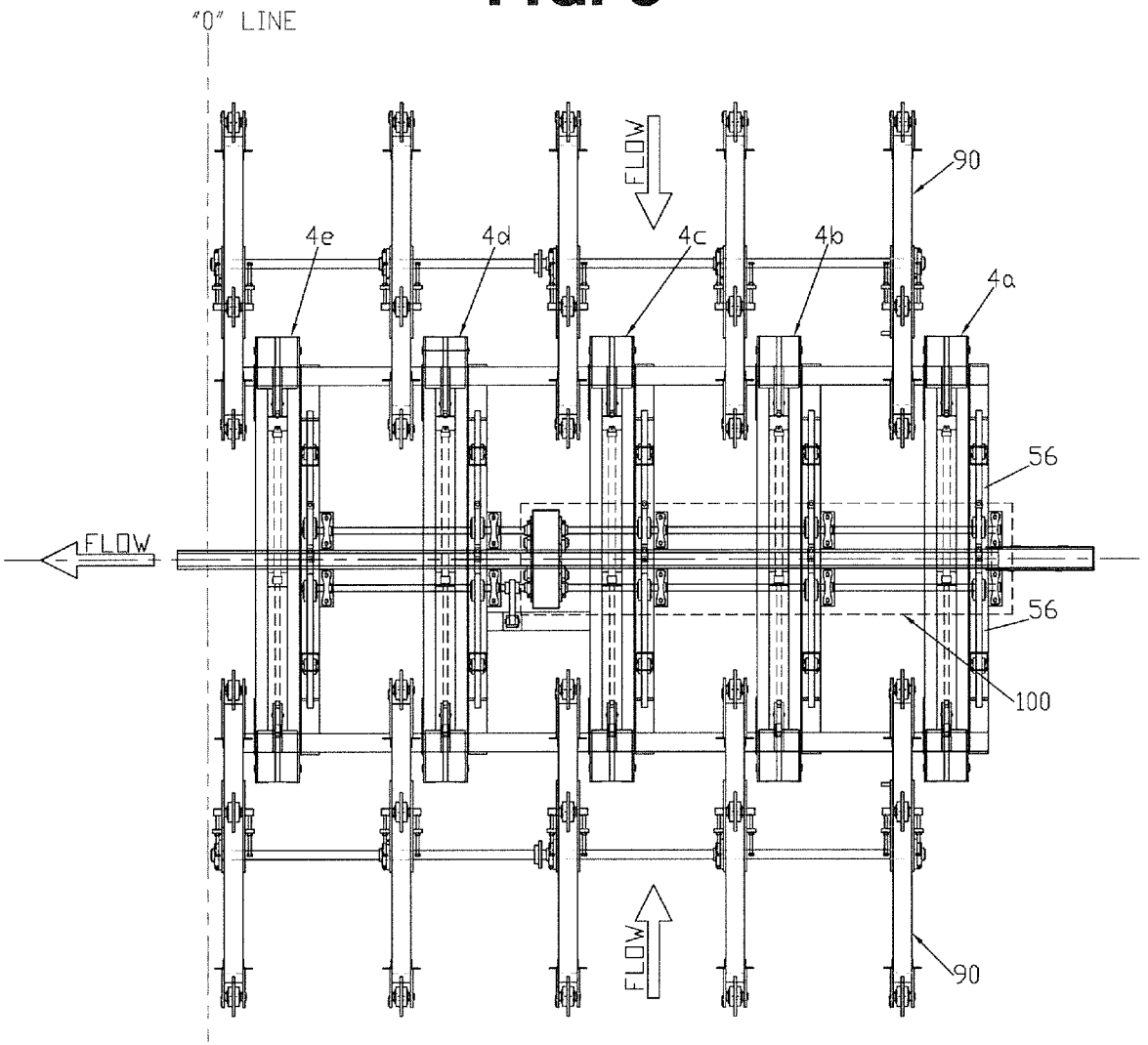
FIG. 3 is an overhead view of the embodiment seen in FIG. 2.

In certain embodiments, the work piece (e.g., a flitch) will be transported to the area where it can be gripped by gripping arms 30 through the operation of lateral feed assembly 90 shown in FIGS. 2 and 3. In the embodiment shown, lateral feed assembly 90 will comprise upright supports 91 which position chain track 92 generally level with and perpendicular to longitudinal transport assembly 3. Chain guide sprockets 93*a* are positioned on each end of chain track 92 and a drive sprocket 93*b* is positioned below chain track 92. A common drive shaft 94 powers all drive sprockets 93*b*. Although removed for clarity, it can be seen how a sharp chain (one example of which could be the Can-Am 80-2-4 PEP described above) will be positioned in chain track 92 and work pieces placed on the moving sharp chain will be transported toward gripper arms 30. In the embodiment shown, there are lateral feed assemblies 90 on each side of handling apparatus 1. However, other embodiments could employ a lateral feed assembly only on one side or could use a feed assembly that is not laterally positioned, i.e., a feed assembly at the beginning of and in line with longitudinal transport assembly 3.

Figure 7:
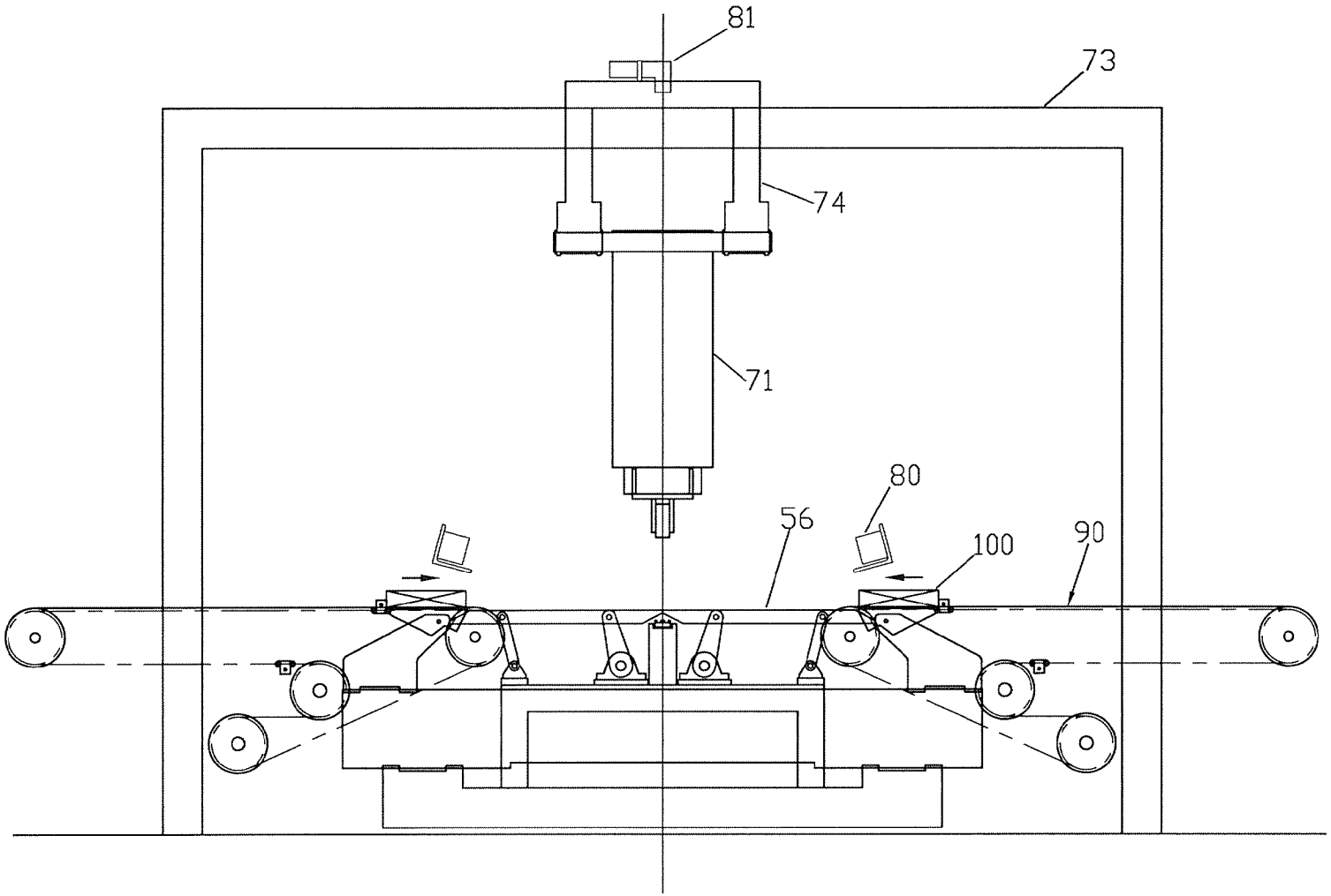
FIG. 7 illustrates the embodiment of FIGS. 1-6 prior to gripping a flitch.
Figure 8:
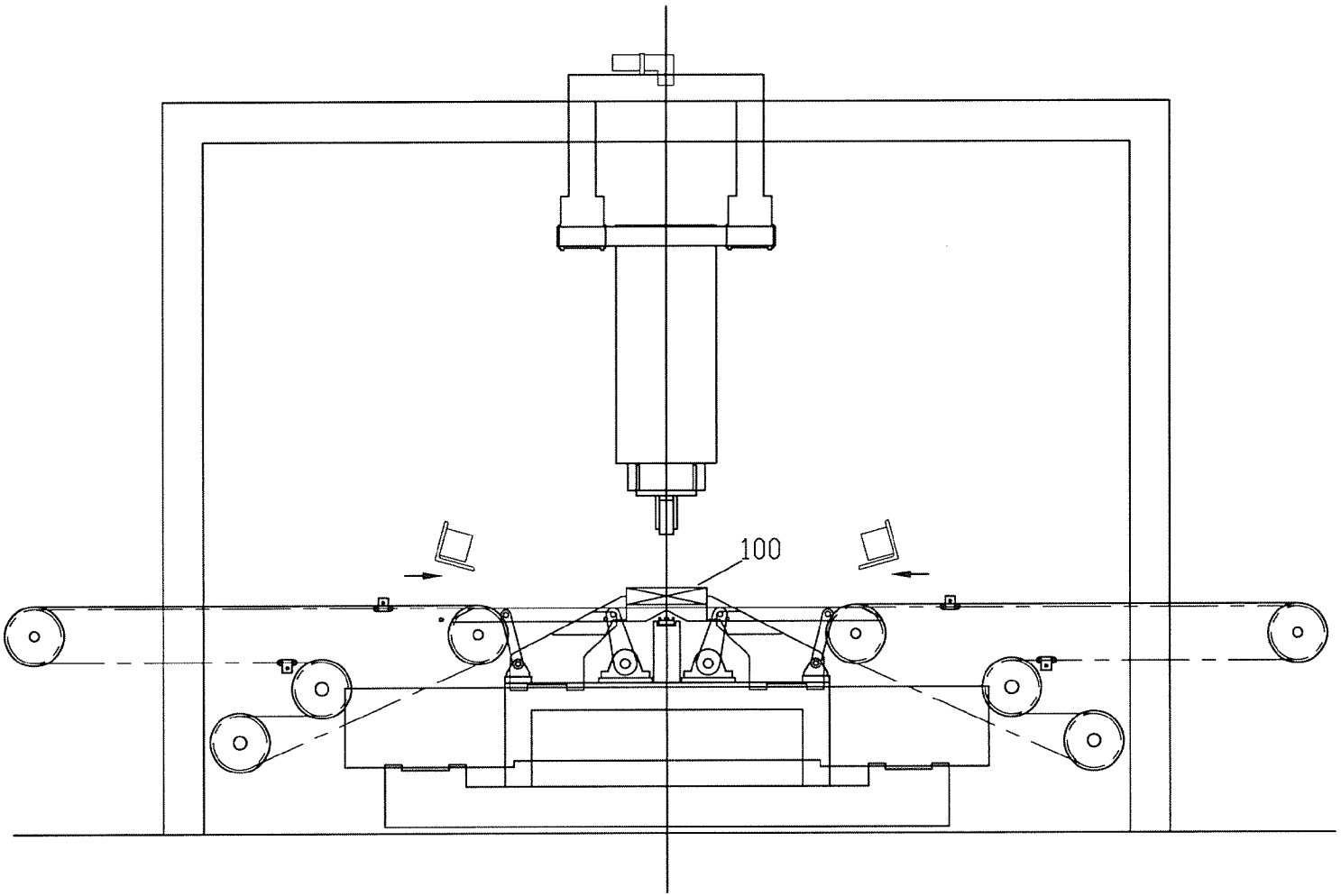
FIG. 8 illustrates the flitch being gripped.

The operation of handling apparatus 1 is described in reference to FIGS. 7 to 11. In FIG. 7, a flitch 100 is positioned on lateral feed assembly 90 and moves toward the center of handling apparatus 1. As the flitch encounters gripper arm 30, it pushes the gripper dog 32 forward and out of its path as gripper dog 32 rotates on pin 34 as described in connection with FIG. 5A. When flitch 100 clears gripper arm 30, the weighted rear section 35 causes gripper arm 30 to pivot back to its upright position. Although not explicitly illustrated, at this point flitch 100 has moved off lateral transport assembly 90 and rests between gripper arms 30 and on top of the right lift arm 56. Gripper arm activation cylinder 24 (see FIG. 5C) will then be contracted to move gripper arms 30 to their center position which will cause the flitch 100 to be gripped and approximately centered over sharp chain 13 as seen in FIG. 8. Preferably, the maximum pressure in activation cylinders 24 are set sufficiently low to prevent gripper arms 30 from crushing the flitch. Once the flitch 100 is securely gripped by gripper arms 30, flitch 100 may be selectively oriented so that the board is most economically edged in the sawing station 105 which follows the transport assembly. One method for determining the best orientation of flitch 100 is described in more detail below. For now it suffices to understand that the orientation of flitch 100 is adjusted based upon certain lumber volume/size maximization algorithms. In order to adjust the orientation of flitch 100, at least one, more preferably at least two, and sometimes more than two sets of gripper arms 30 are moved on their respective gripper arm support platforms 4. In the embodiment shown, each of the gripper arm support platforms 4 will independently move their respective gripper arms 30 (while in the closed position) either to the left or right (from the perspective seen in FIG. 5A) to achieve a previously calculated orientation. However, in other embodiments it may not be necessary for all support platforms to move independently. As an illustrative example, FIG. 3 depicts an embodiment with five gripper arm support platforms 4*a*-4*e* (naturally other embodiments could have more of fewer support platforms 4). When a flitch 100 moves onto lift arms 56, typically at least two sets of gripper arms 30 will move inward to secure flitch 100. Proximity sensors (ultrasonic sensors in one embodiment) may be located near each set of gripper arms 30 and will indicate which pairs of gripper arms 30 can grip flitch 100 given its length. The type or location of the sensors is not critical, it is simply preferred that it be determinable which sets of gripper arms 30 are capable of engaging flitch 100. Preferably, the two pairs of gripper arms 30 closest to the ends of the flitch 100 (e.g., gripper arms 30 on support platforms 4*a* and 4*c* in FIG. 3) will move toward and engage flitch 100. If it is desired to rotate or skew flitch 100 clock-wise, then the skewing cylinder 47 associated with gripper arm support platform 4*a* will support platform 4*a* to the left (toward the bottom of the page in FIG. 3) while the skewing cylinder 47 associated with support platform 4*c* will move that support platform to the right (toward the top of the page in FIG. 3). Of course, it is possible that the preferred flitch orientation requires the movement of both gripper arm support platforms 4 in the same direction or the movement of only one gripper arm support platform 4. As suggested above, other embodiments might involve the movement of three or more gripper arm support platforms 4.

Figure 10:
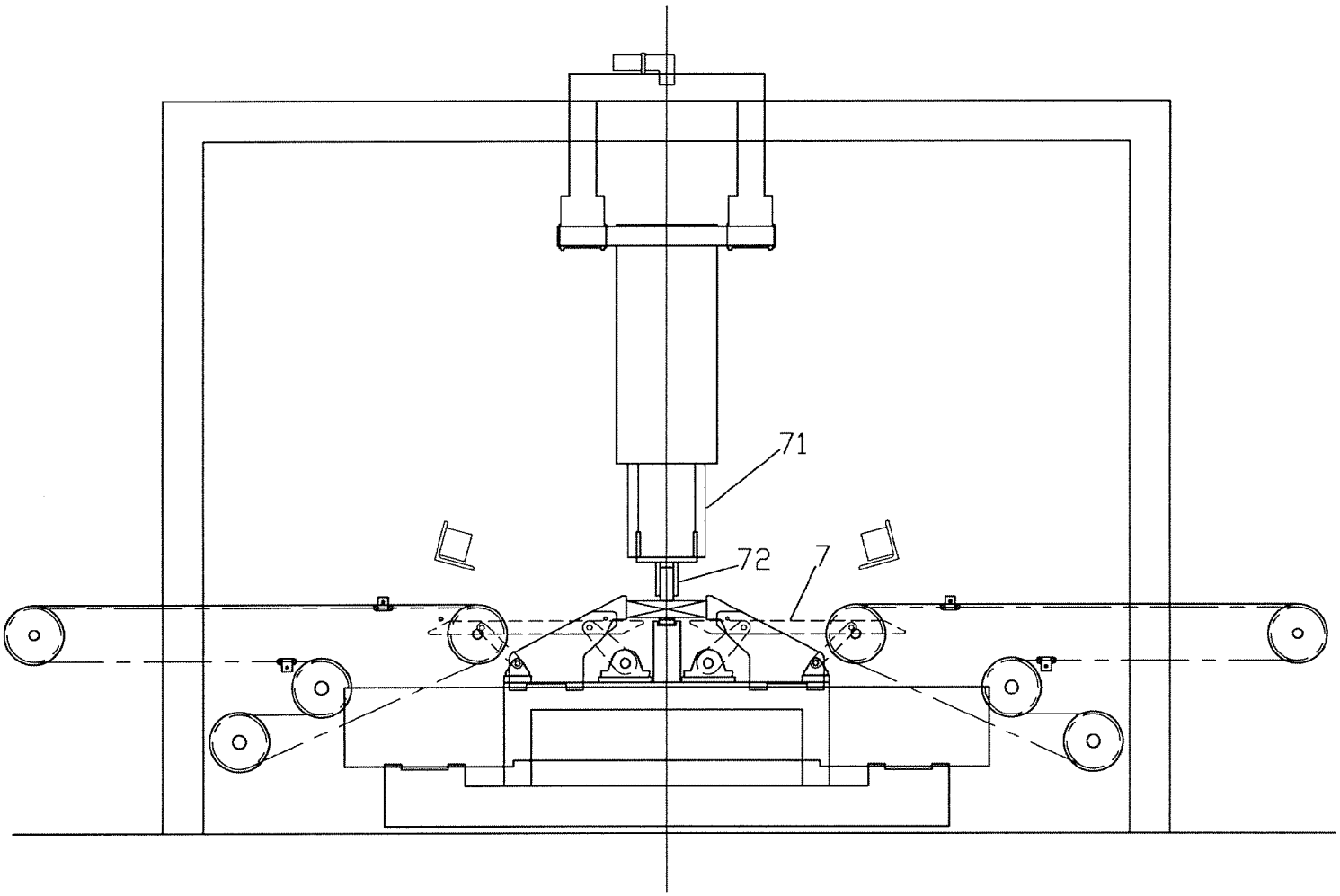
FIG. 10 illustrates the hold-down assembly gripping the flitch.
Figure 11:
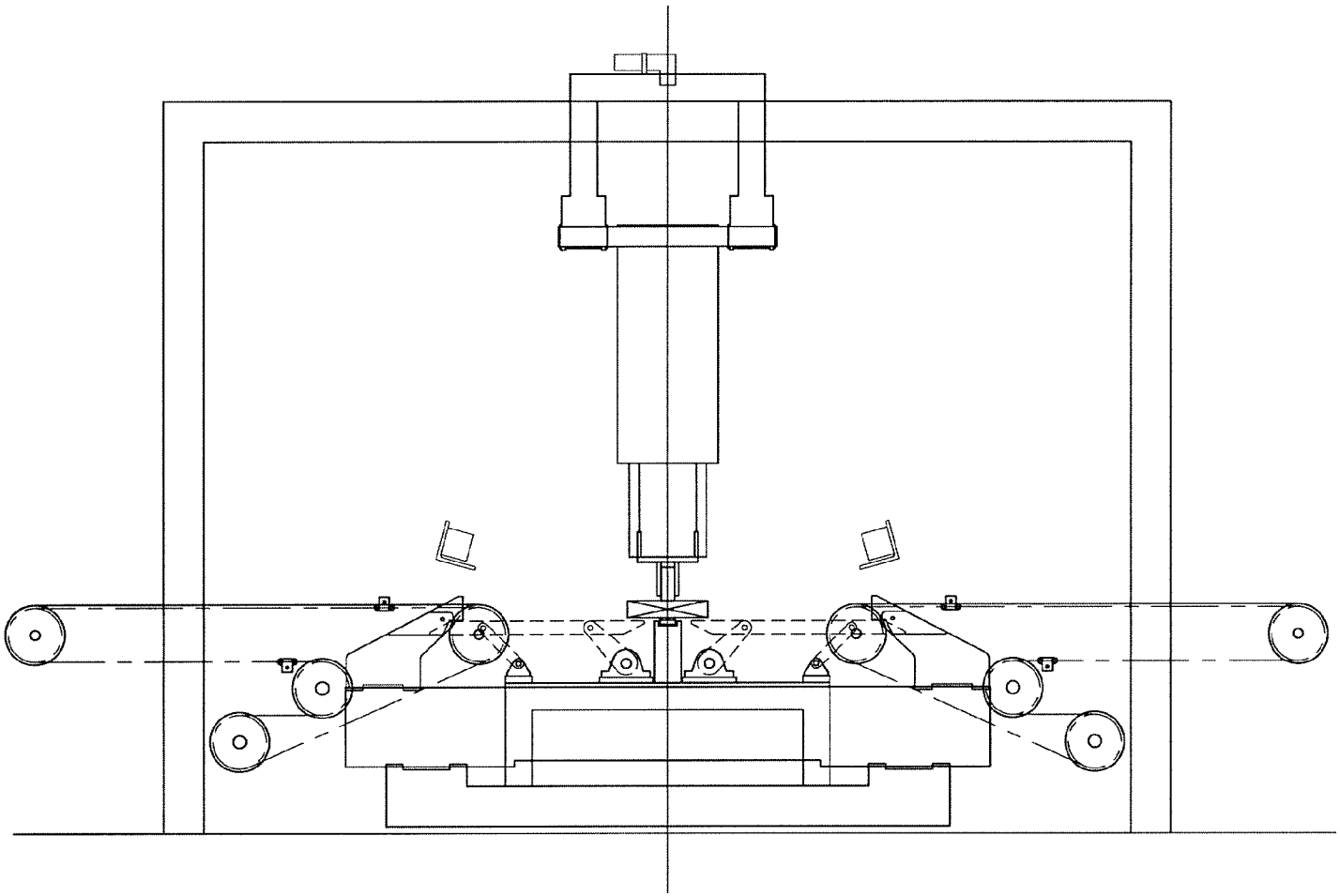
FIG. 11 illustrates the gripper arms releasing the flitch.

Once the flitch 100 has been skewed to the desired orientation, the means for holding flitch 100 will transition from gripper arms 30 and lift arms 56 to hold down assembly 70 and sharp chain 13 as suggested by FIGS. 10 and 11. In FIG. 10, lift arms 7 and the piston arm of hold down cylinder 71 are lowered until flitch 100 is resting on sharp chain 13 and held firmly in place by hold down roller 72. Because gripper arms 30 are still in position at this point, the orientation of flitch 100 is not altered. As suggested in FIG. 11, once flitch 100 is firmly gripped by hold down roller 72 and sharp chain 13, gripper arms 30 release and move away from flitch 100. At this point, sharp chain 13 may begin to move in the direction which takes flitch 100 toward saw station 105 (see FIG. 4). As flitch 100 moves toward saw station 105, the hold down function will be transferred from roller to adjacent roller down the length of handling apparatus 1. It will be understood that in the embodiment shown, each of the hold down cylinders 71 previously lowered their respective hold down rollers 72 to the same height in order that flitch 100 would be gripped with the same force (and thus maintain the same orientation) as it moves down the length of handling apparatus 1.

Figure 9:
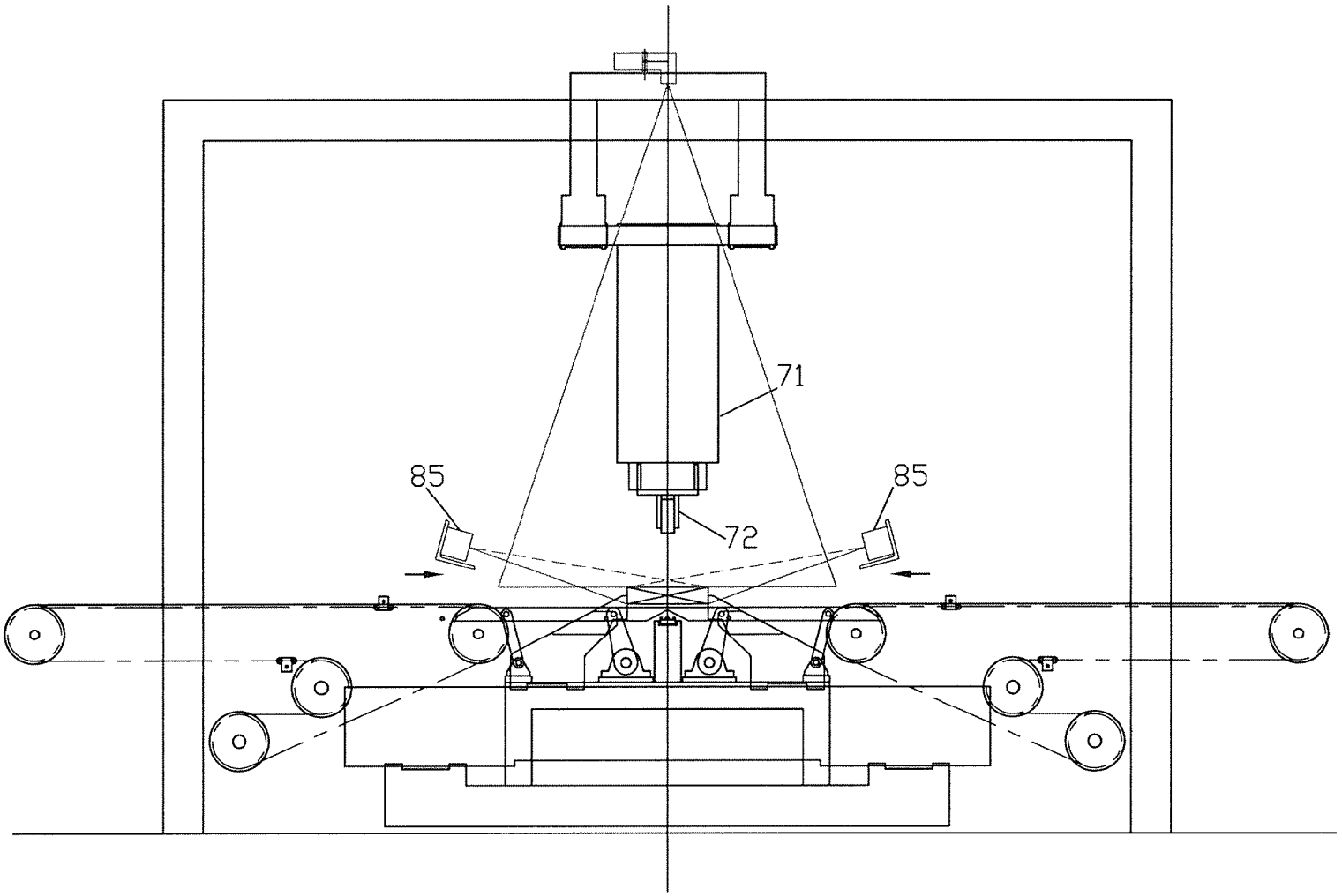
FIG. 9 illustrates the flitch being scanned.

In order to determine the optimal orientation of flitch 100 and to provide skewing instructions to the gripper arm support platforms 4, it is typically necessary to obtain information concerning the dimensions of flitch 100. In one embodiment, flitch 100's dimensions will be determined using camera imaging technology. FIG. 4 illustrates a series of cameras 81 positioned on overhead frame 73. Each camera 81 will have a field of view 82 which covers a section of flitch 100 (not shown in FIG. 4) below it. It can be seen that the fields of view 82 (and/or the height of cameras 82) are adjusted such that each camera 82 will image an adjacent section of flitch 100 and the sequence of images captured by successive cameras 82 will create a composite image of the entire length of flitch 100. In the embodiment shown, cameras 82 will capture images of flitch 100 prior to hold down rollers 72 being lowered into position. FIG. 9 illustrates how in one embodiment, infra red LED light sources 85 will illuminate flitch 100. In some instances, the lights 85 on each side will strobe (alternate in their illumination of) flitch 100 in order to create shadows which will assist a computerized imaging system in determining dimensional information.

Although not explicitly illustrated in the Figures, one sawing station 105 which could be employed (typically in a semi-manual rather than a fully automatic mode) with handling apparatus 1 would project a visible (e.g., red) laser beam line associated with each saw blade down the length of sharp chain 13 (i.e., one laser beam line on each side of side of sharp chain 13). These laser beam lines indicate the position of opposing saw blades in sawing station 105. Thus, when a flitch 100 is positioned on shape chain 13, the laser beam lines will appear on each edge of flitch 100 to indicate exactly where on the flitch 100 the saws will cut if the flitch 100 continues to saw station 105 in that orientation.

Figure 12:
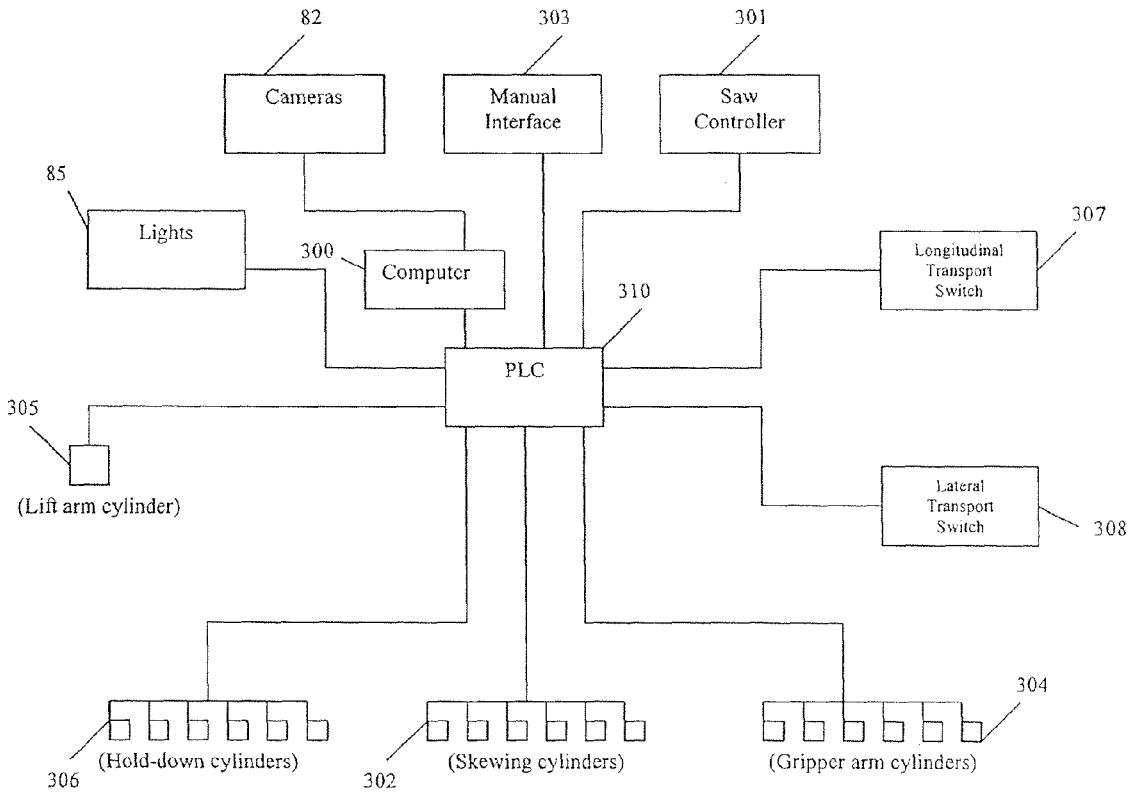
FIG. 12 is a schematic of one embodiment of a control system.

A schematic representation of one embodiment of a control system employed in the present invention is shown in FIG. 12. A computer 300 (e.g., a conventional PC) will communicate with programmable logic controller (PLC) 310. While computer 300 directly communicates with cameras 82 and provides instructions to PLC 310, most elements in FIG. 12 are directly controlled by PLC 310. These elements include control of lights 85, saw controller 301 (e.g., the mechanism controlling the position of the saw blades), and switches 307 and 308 which activate longitudinal transport assembly 3 and lateral transport assemblies 90. The PLC may also activate the control valves (e.g., solenoid valves) which supply fluid to the various piston and cylinder assemblies. These include control valve 305 for lift arm cylinder 61, control valves 306 for hold down cylinders 71, control valves 302 for skewing cylinders 47, and control valves 304 for gripper arm cylinders 24. PLC 310 may receive inputs from a manual user interface 303 such as the operator joy stick described below.

In the embodiment suggested in FIG. 12, the orientation of flitch 100 may be controlled by two separate means. One control means would be a "manual" positioning system where an operator views the laser beam lines on flitch 100 (either directly or through an image captured by cameras 82 and projected on a viewing monitor) and then uses a "joystick" or other user interface control in order to adjust the orientation of the flitch 100 (via skewing assembly 5) until flitch 100 lies at the desired orientation under the laser beam lines described above. Then hold down rollers 72 will fix flitch 100 against sharp chain 13 and sharp chain 13 will advance flitch 100 to saw station 105 in the desired orientation.

Figure 13:
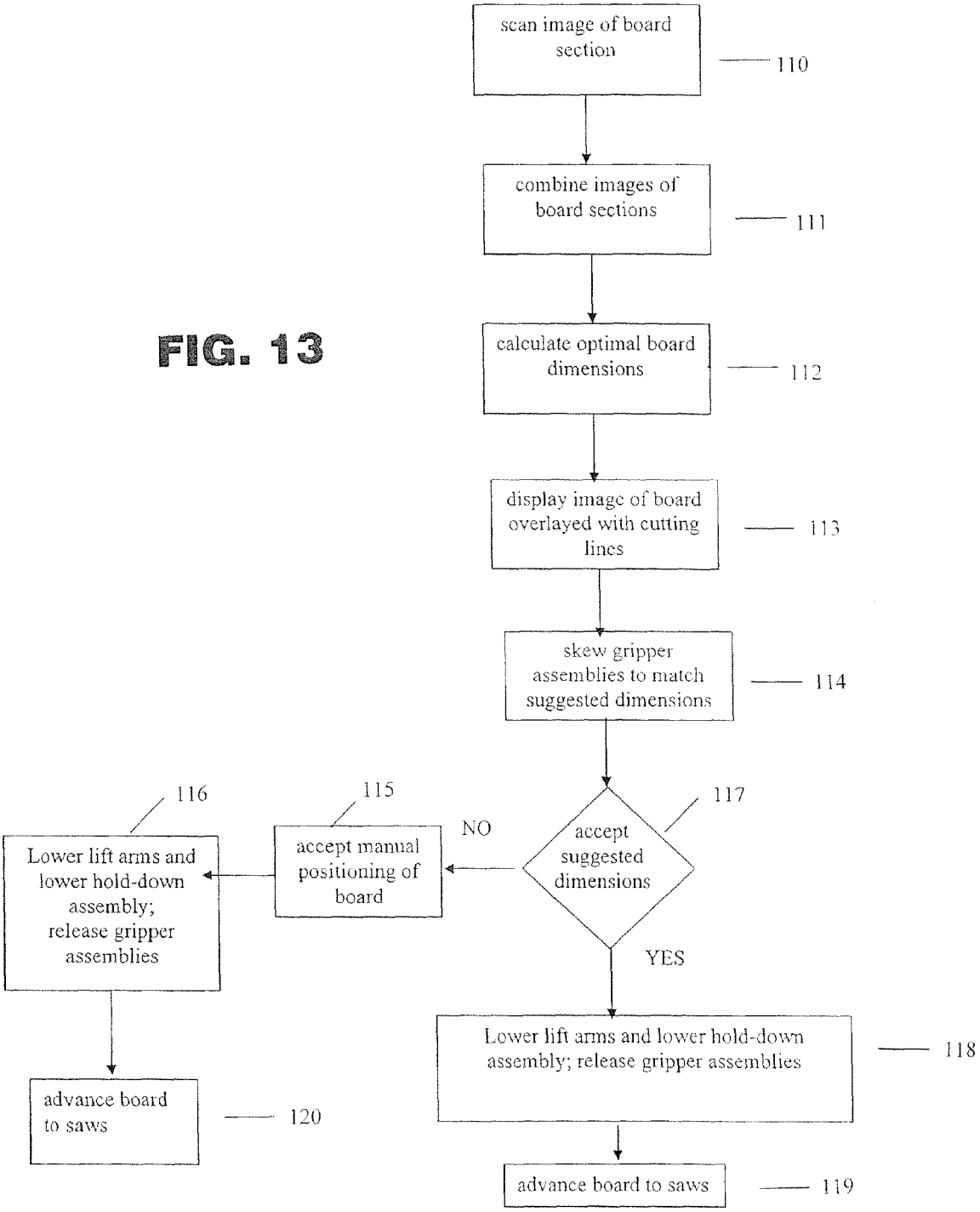
FIG. 13 is a flow chart illustrating steps carried out by one method of the present invention.

A second control means would be utilization of computer generated orientation instructions derived from image data captured by cameras 82. One example of a software system which generates such orientation instructions is provided under the trademark Infra Red Inline Scanner or IRIS™ by AE Automation Electronics of Mount Maunganui, New Zealand. FIG. 13 suggests a basic set of steps such a software system would employ. After the gripper arms 30 grip and approximately center the flitch 100 over sharp chain 213, cameras 82 will scan their respective sections of flitch 100 (step 110). In step 111, the separate camera images are combined to create a complete image. From the image data, an algorithm is capable of calculating the optimal cutting dimensions which will maximize the amount of usable finished lumber from flitch 100 (step 112) and flitch 100 will be displayed to an operator with the computer generated overlay showing the proposed cutting lines on the image of flitch 100 (step 113). Next, the relevant gripper arm support platforms 4 will be skewed to orient flitch 100 in line with the computer generated cutting solution (step 114). In step 117, the operator will be given the choice of whether to accept the computer generated cutting solution or to employ the manual positioning described above. Steps 115, 116, and 120 represent the operator choosing manual positioning of flitch 100, positioning flitch 100, releasing the gripping assemblies/lowering the hold-down assemblies, and advancing flitch 100 to saw station 105 based on such manual orientation. If the operator accepts the computer generated cutting solution, then flitch 100 will be lowered by lift arms 7, gripped between hold down roller 72 and sharp chain 13, released by the gripper assemblies (step 118) and finally advanced to saw station 105 (step 119).

Figure 14:
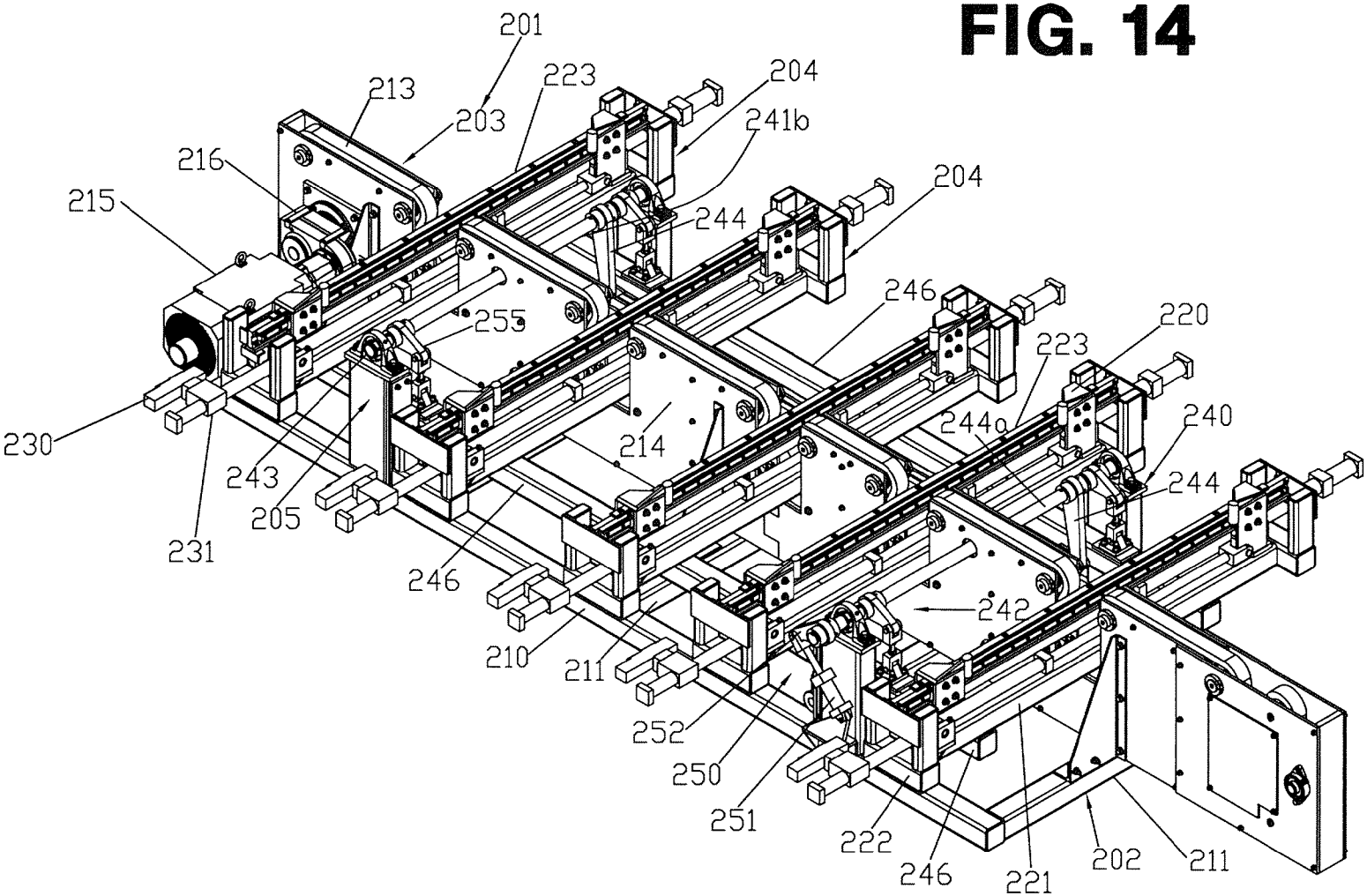
FIG. 14 is a perspective view of an alternate embodiment of the present invention.

FIG. 14 illustrates an alternate embodiment of the present invention, handling apparatus 201. Similar to the previous embodiment, handling apparatus 201 will generally comprises a base frame 202, gripper arm support platforms 204, gripper arms 220, and longitudinal transport assembly 203. Base frame 202 includes at least two longitudinal frame members 210 and a series of lateral frame members 211 positioned between longitudinal frame members 210.

Figure 17:
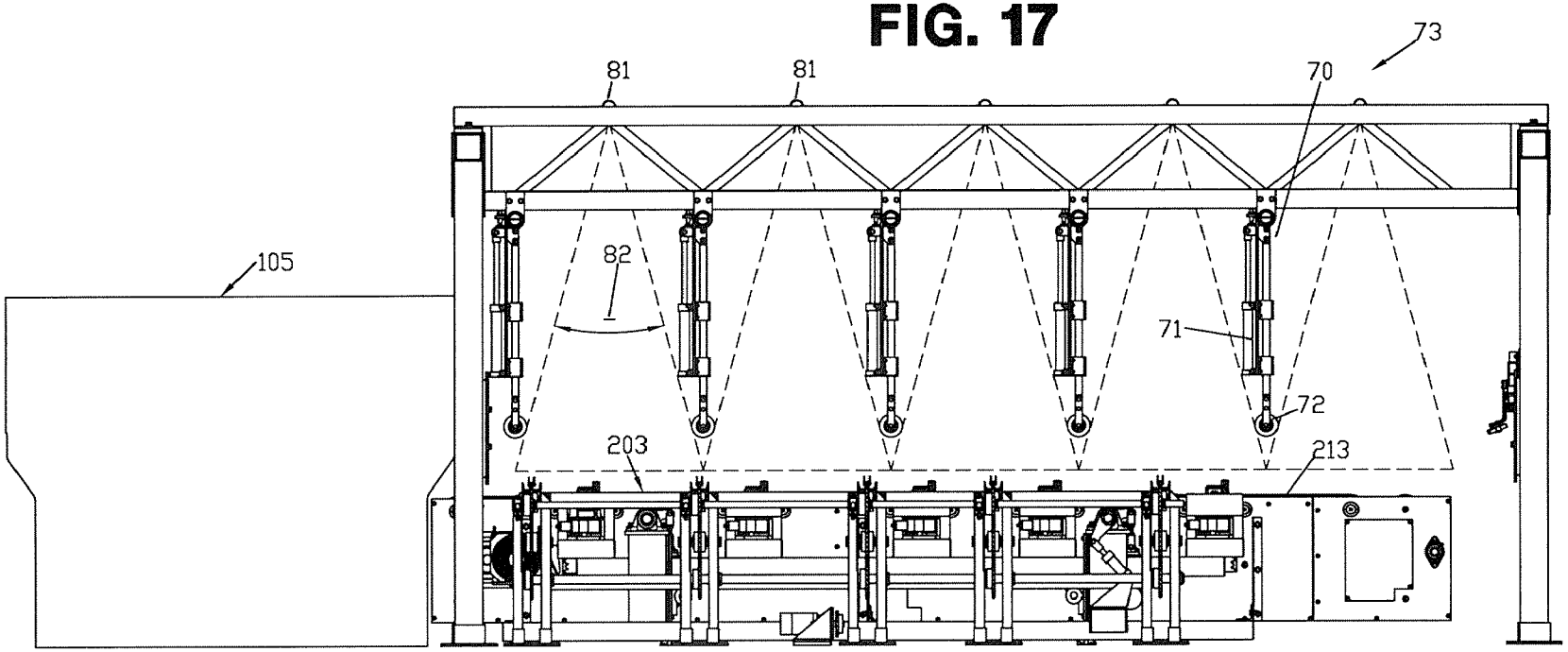
FIG. 17 side schematic view of one embodiment of a hold-down assembly.

Although the embodiment of longitudinal transport assembly 203 seen in FIG. 14 also includes a sharp chain 213 which runs in a continuous loop, the path of sharp chain 213 differs from the embodiment of FIG. 1. In FIG. 14, sharp chain 213 travels in a circuitous path around the gripper arm support platforms 204. Sharp chain 213 approaches support platforms 204 at a level approximate to the upper rails 223 (explained below), then travel downward extending beneath support platforms 204, and rising again to a level approximate rails 223 as it approaches the next support platform 204. Although hidden from view in sharp chain enclosure 214, it will be understood that a system of chain sprockets guide sharp chain 213 along this circuitous course. As in previous embodiments, sharp chain 213 will be driven by chain sprockets which are positioned within gear box 216. Any conventional source of torque such as motor 215 may power drive sprockets and cause the rotation of sharp chain 213. Also similar to the earlier embodiment, FIG. 17 illustrates how a conventional sawing station 105 will be positioned at the end of longitudinal transport assembly 203.

In addition to sharp chain 213, the hold-down assembly 70 (best seen in FIG. 17) is similar to that described above. An overhead frame 73 is positioned over sharp chain 213 and a series of linear actuators (e.g., hold-down piston and cylinder assemblies 71) are suspended from over head frame 73. Each hold-down cylinder 71 will have a roller 72 positioned on the end of the piston arm which may be retracted above a flitch positioned over sharp chain 213 or may be extended downward to capture a flitch between roller 72 and sharp chain 213. In some embodiments, the rollers 72 will have grooved wheels to better prevent slippage between the flitch and the wheels. Certain embodiments of the hold-down assembly 70 may position the hold-down cylinders differently from what is shown in the figures. For example, the hold-down roller 71 shown closest to saw station 105 could alternatively connect to the housing of saw station 105 and pivot downward to engage the flitch.

Figure 15:
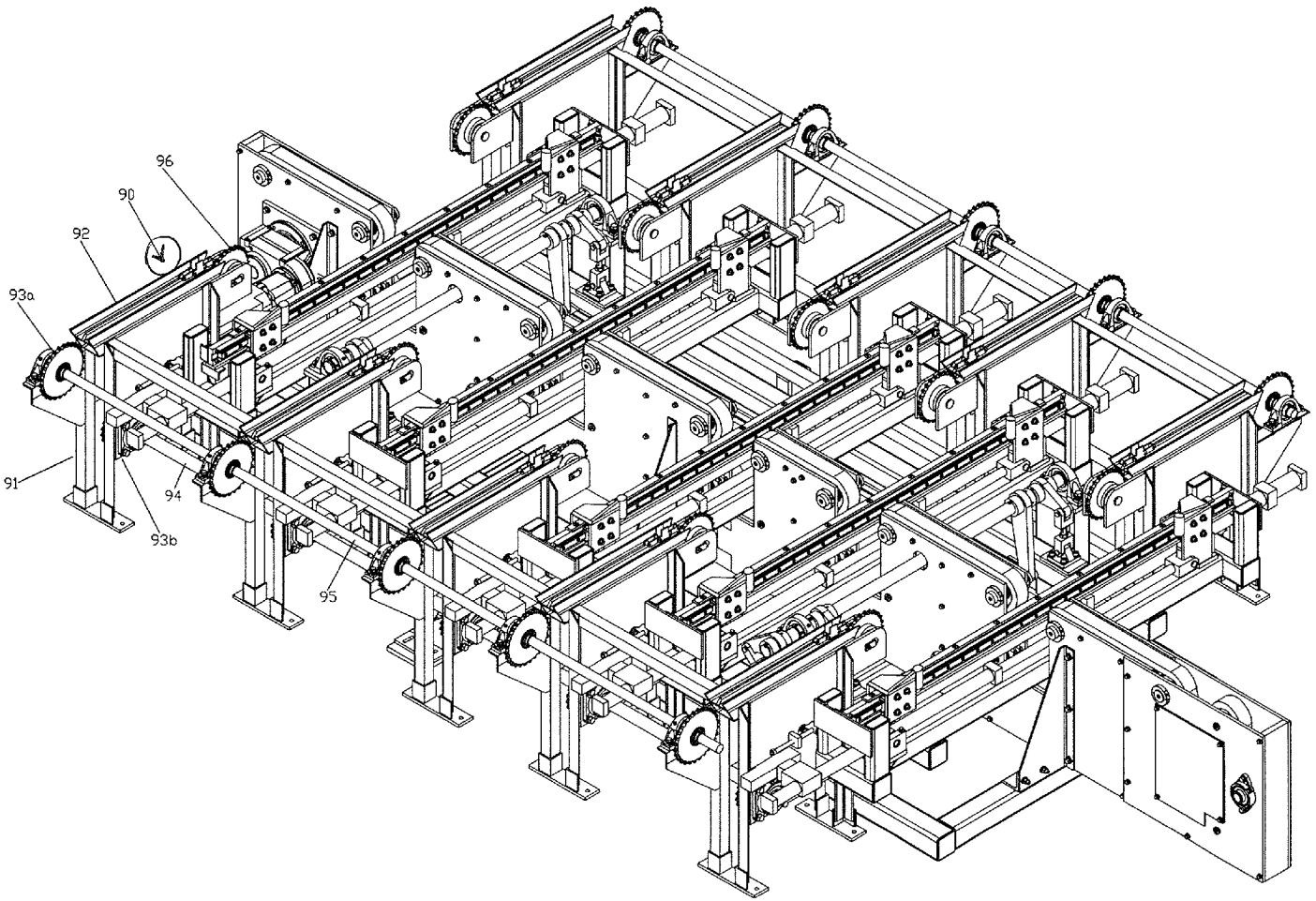
FIG. 15 illustrating a lateral feed mechanism connect to the embodiment of FIG. 14.
Figure 16:
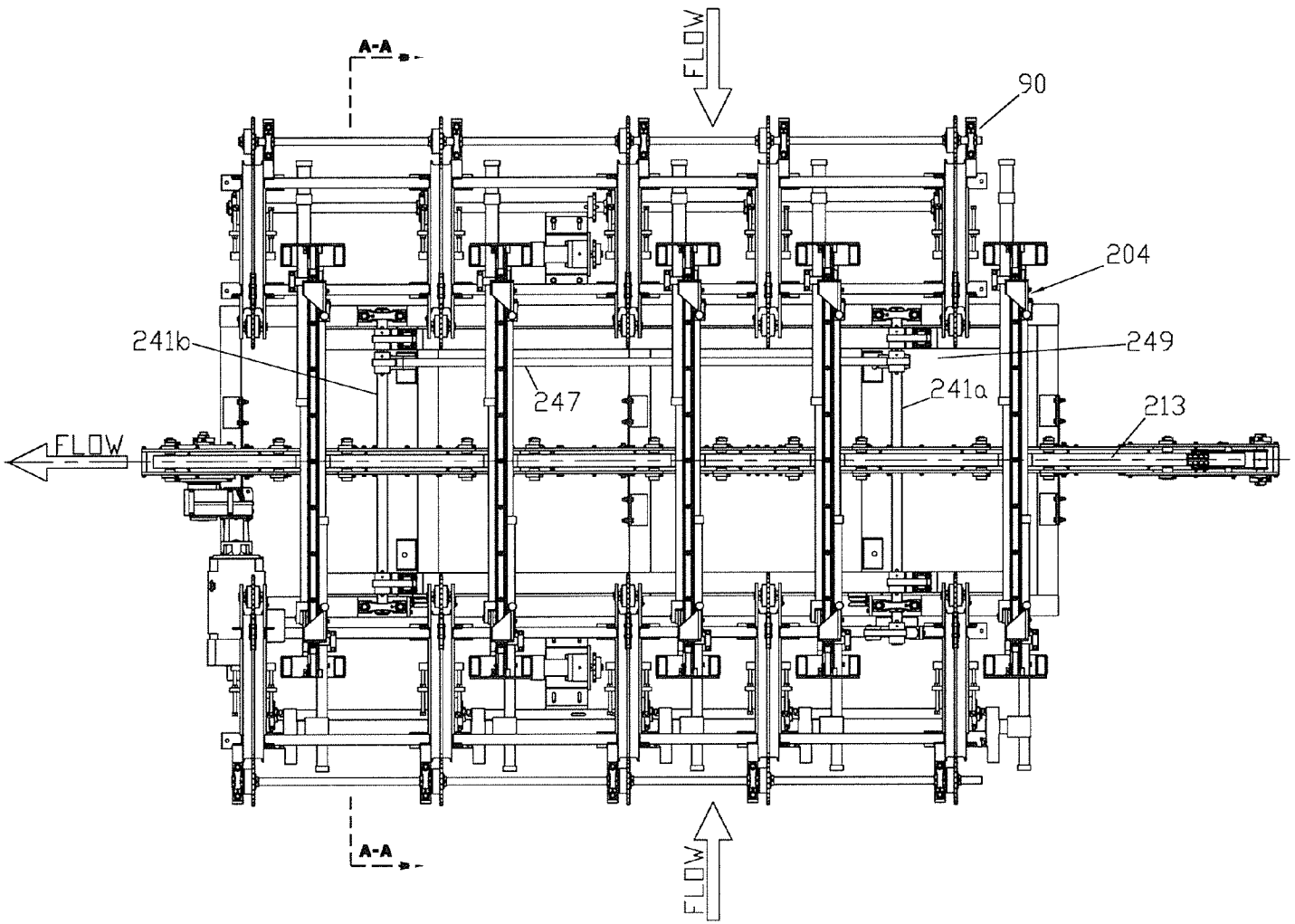
FIG. 16 is an overhead view of the embodiment seen in FIG. 15.

Likewise, the lateral feed assembly 90 shown in FIGS. 15 and 16 is similar to that of FIGS. 2 and 3. In the embodiment shown, there are lateral feed assemblies 90 on each side of handling apparatus 201. However, other embodiments could employ a lateral feed assembly only on one side or could use a feed assembly that is not laterally positioned, i.e., a feed assembly at the beginning of and in line with longitudinal transport assembly 203. Although not explicitly shown in the drawing, each lateral feed assembly 90 will have at least one proximity sensor or other detection mechanism which will detect whether a flitch is positioned on the chain associated with that lateral feed assembly. These sensors will provide data on how many lateral feed assemblies 90 the flitch extends across and therefore, an approximate length of the flitch.

Figure 18A:
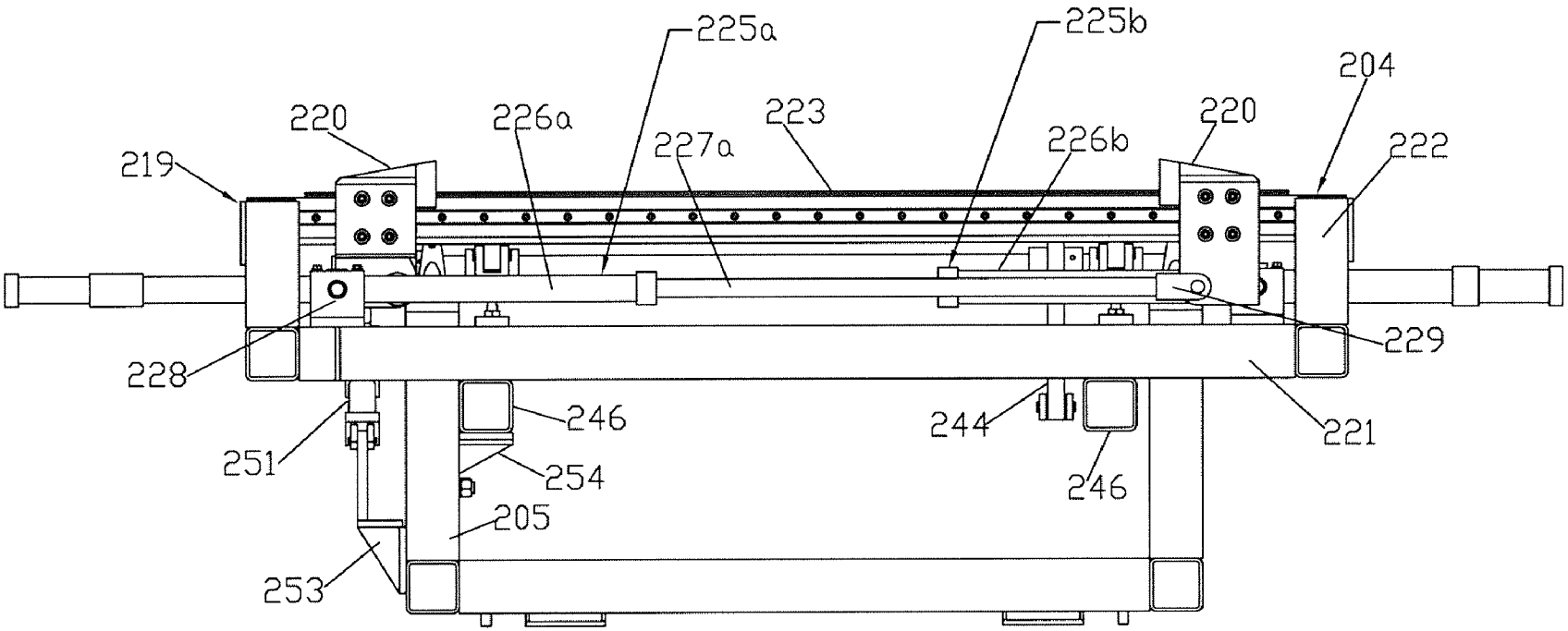
FIGS. 18A to 18D illustrate views of one embodiment of the gripper arms and positioning assembly of the present invention.
Figure 18B:
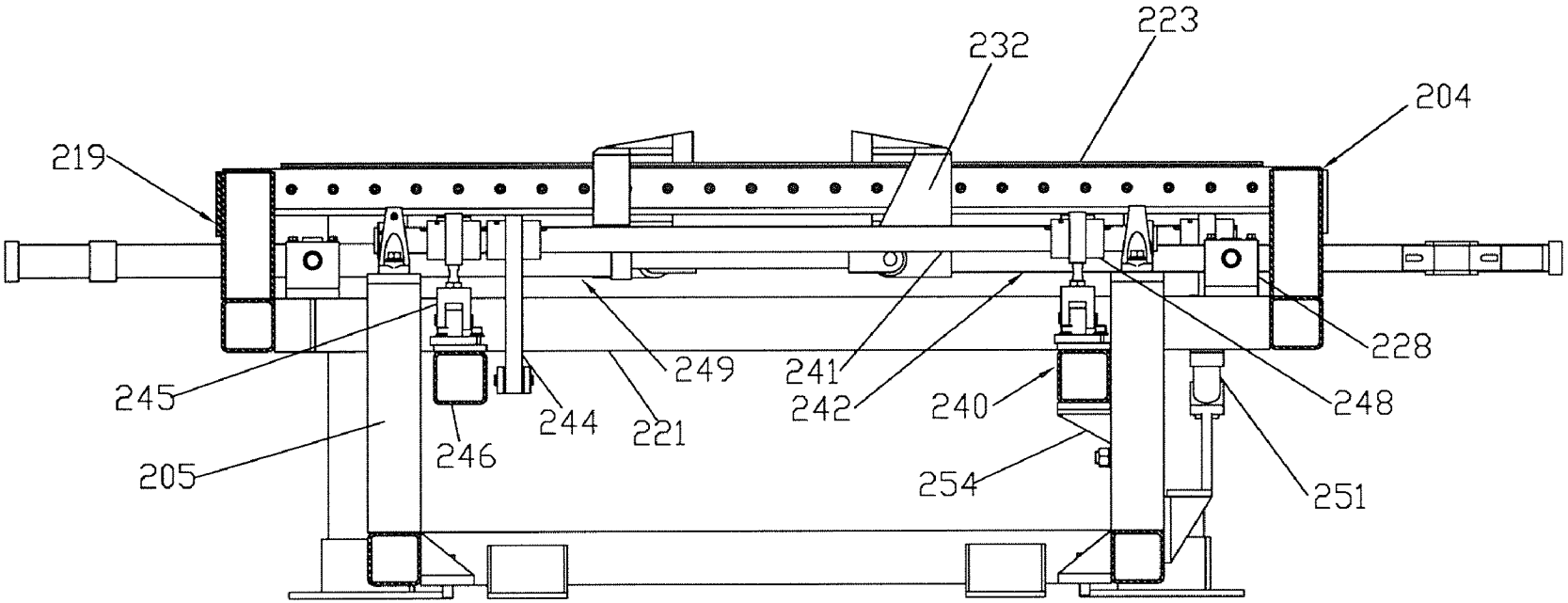

Although the embodiment of FIG. 14 also has a plurality of gripper arm support platforms 204, these gripper arm support platforms differ (as do the gripper arms) from those seen previously. As better seen in FIGS. 18A and 18B, gripper arm support platforms 204 generally comprise support platform base beam 221, support platform end sections 222 and upper or top rail 223. In the embodiment of FIG. 18A, gripper arms 220 are positioned on upper rail 223. As best seen in FIG. 18B, these gripper arms 223 will include a guide sleeve 232 securing gripper arms 220 to upper rail 223 and allowing the gripper arms to slide left and right on upper rail 223. However, the invention is not limited to gripper arms slidingly mounted on upper rail 223. For example, in alternative embodiments, gripper arms 220 could be mounted on an alternate mounting base positioned to one side of upper rail 223. The main consideration is that upper rail 223 be able to move up and down and that gripper arms 220 be able to grip a flitch lying across one or more upper rails 223 (although the invention is not necessarily limited to devices with these functions).

In the embodiment of FIGS. 18A to 18D, gripper arms 220 are moved toward and away from sharp chain 213 though positioning assembly 219. Positioning assembly 219 includes actuators such as piston and cylinder assemblies 225*a* and 225*b* formed of cylinder bodies 226 and piston arms 227. In FIG. 18A, cylinder bodies 226 are fixed to base beam 221 by way of cylinder clamps 228 and the distal end of piston arms 227 have a fork 229 which is pinned to gripper arms 220. It can be seen that cylinder assemblies 225*a* and 225*b* are positioned in an opposing orientation such that extension and retraction of the respective piston arms 227 moves the gripper arms 220 in opposite directions along upper rail 223, i.e., either toward and away from one another. In this embodiment, cylinders assemblies 225*a* are hydraulic while cylinders assemblies 225*b* are pneumatic.

The ends of hydraulic cylinder bodies 226*a* will include mounting blocks 231 (FIG. 14) to which hydraulic control valves 230 will be attached. Each hydraulic control valve will direct hydraulic fluid to cylinder body 226*a* which is mounted on the gripper arm support platform 204 (fluid lines have been omitted for clarity). Hydraulic piston and cylinder assemblies 225*a* will be double acting assemblies and connected to control valve 230 such that control valve 230 may cause gripper arms 220 to move toward and away from sharp chain 312. This embodiment will require at least two hydraulic lines extending to each cylinder 226. The position of piston arms 227 (and thus gripper arms 220) will be monitored using linear transducers placed within cylinder bodies 226*a*. In one embodiment, control valves 230 are hydraulic proportional valves allowing accurate positioning of the gripper arms operated by hydraulic cylinder assemblies 225*a*. In one nonlimiting example, piston and cylinder assemblies are controlled with sufficient precision to allow as little as 1.5 mm movement left or right by gripper arms 220, but in other situations, less precise control may be acceptable. In the embodiment shown, hydraulic proportional valves and the linear transducers (i.e., magnetostrictive displacement transducers) are both sold under the Temposonic trademark by MTS Systems Corp. of Cary, N.C. Naturally, those skilled in the art will recognize many other ways to control cylinder assemblies 225 and those should be considered within the scope of the present invention.

The pneumatic or air cylinder assemblies 225*b* will include two air inputs allowing pressurized air to move the piston arm 227*b* toward and away from sharp chain 312. Solenoid control valves will introduce and release pressurized air into cylinder assemblies 225*b*. Additionally, air cylinder assemblies 225*b* will have linear transducers to indicate the position of the gripper arms associated with the air cylinder assemblies Another element of handling apparatus 201 is platform elevating assembly 240 whose elements are best seen by comparing FIGS. 14 and 18B. Platform elevating assembly 240 includes lifting beams 246, pivoting linkage 242, torque transfer rod 241, power transfer linkage 249, and elevation assembly actuator 250 (see FIG. 14). FIG. 14 illustrates how support platform base beams 221 rest on lifting two beams 246. Lifting beams 246 will in turn rest on beam support shoulder (FIG. 18A) connected to frame column 205. FIG. 14 also shows frame columns 205 supporting torque transfer rods 241 in mounting collars 243. The lifting beams 246 can be raised and lowered by the interaction of pivoting linkage 242 and torque transfer rod 241. The linkage footing 245 will be attached to lifting beams 246 (FIG. 18B) and to linkage arm 255 (FIG. 14) and then to linkage collar 248, which attaches to torque transfer rod 241. From this arrangement, it can be seen that rotation and counter rotation of torque transfer rod 241 will act to raise and lower lifting beam 246, and therefore gripper arm support platforms 204.

The source of torque for torque transfer rod 241 is platform elevation assembly actuator 250. In the embodiment seen in the figures, actuator 250 comprises piston and cylinder assembly 251 acting on actuator linkage 252, which is connected to torque transfer rod 241. Extension and retraction of piston and cylinder assembly 251 thereby acts to rotate torque transfer rod 241. The embodiment of FIG. 14 shows only one elevation assembly actuator 250 acting on a torque transfer rod 241. In order deliver torque to the second (or any number of additional) torque transfer rod(s) 241, this embodiment employs torque transfer arms 244 and transfer bar 247 (seen in FIG. 16). Viewing FIGS. 14 and 16, will be understood that torque delivered to torque transfer rod 241*a* by actuator 250 will cause the rotation of transfer arm 244, imparting linear movement to transfer bar 247, which causes rotation of the transfer arm 244 connected to torque transfer arm 241*b*. In this manner, one actuator 250 will operate to deliver substantially equal and simultaneous torque to both torque transfer rods 241. Naturally torque could be delivered to torque transfer rods 241 by many other methods such as a separate actuator associated with each torque transfer rod 241. Nor are actuators 250 limited to linear actuators but could be other mechanism, non limiting examples of which include a hydraulic motor with a rack and gear assembly; a scissor lift mechanism, or even the concept of raising or lowering the sharp chain itself.

Figure 18C:
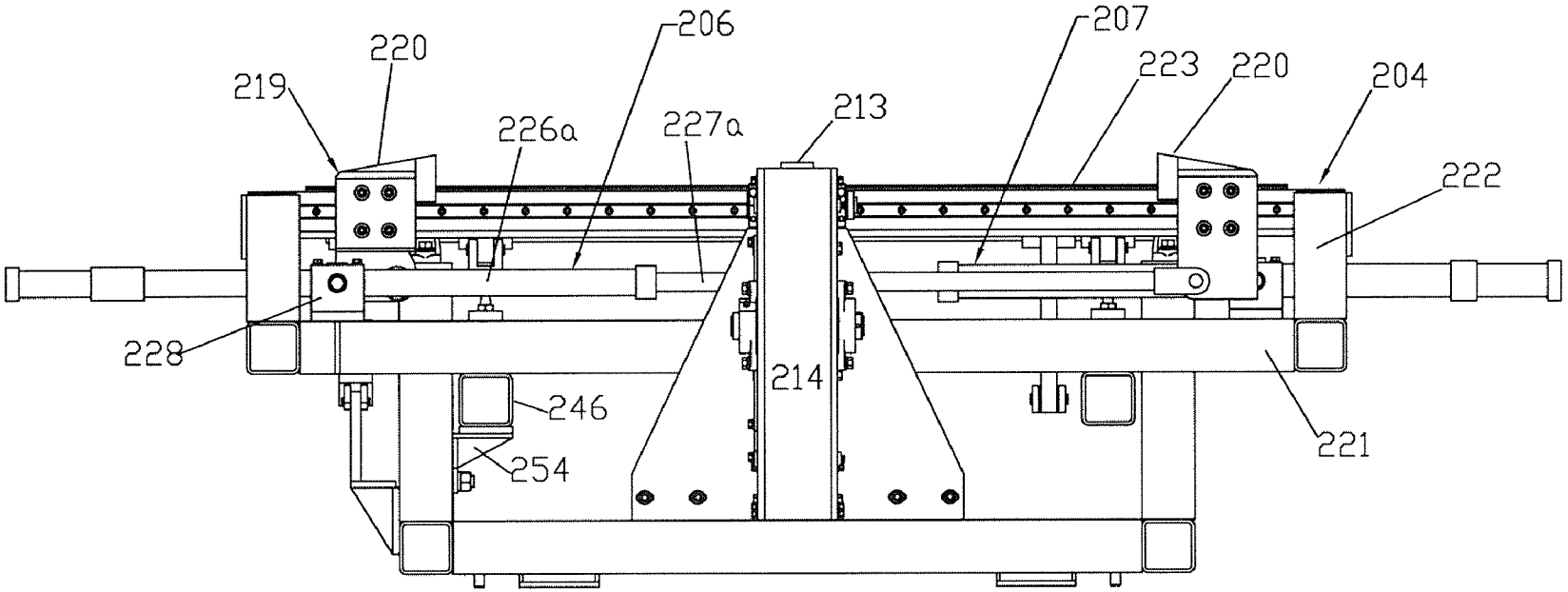
Figure 18D:
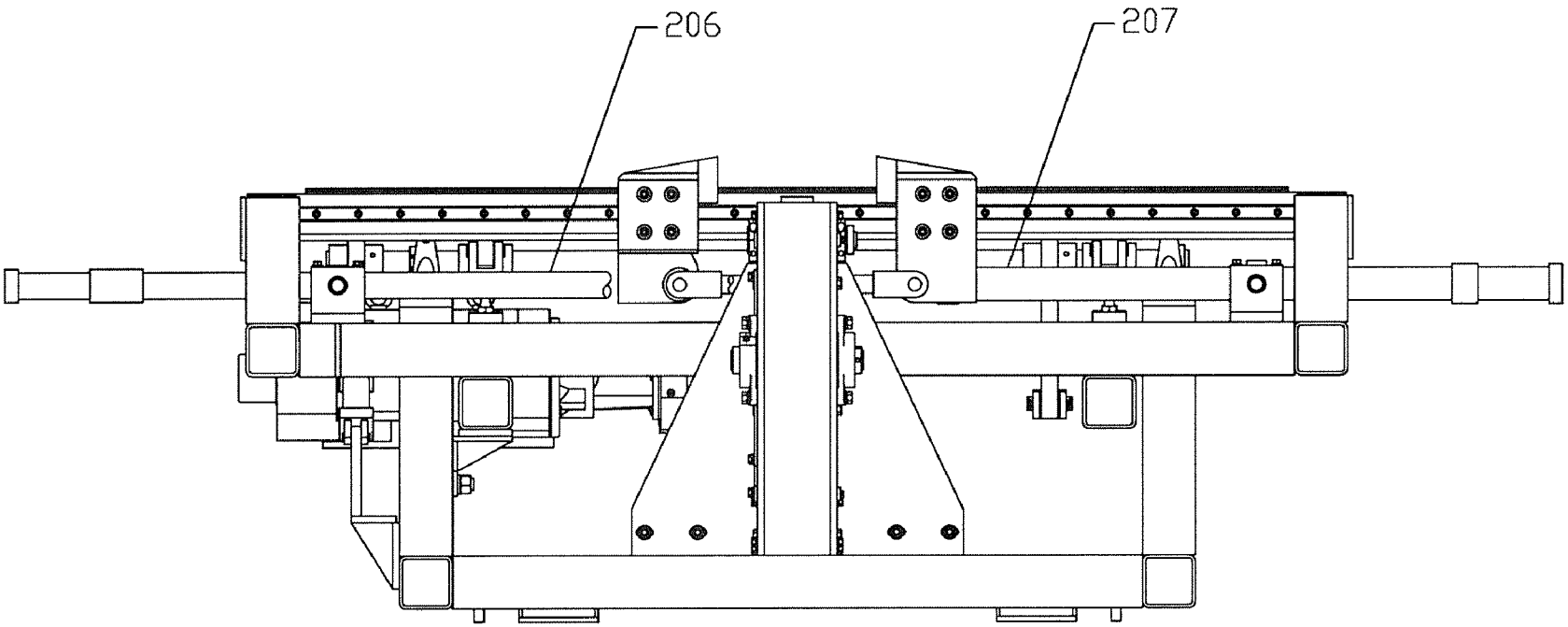

FIGS. 18C and 18D demonstrate the change in relative positions of the upper rail 223 and sharp chain 213 in the illustrated embodiment of the invention. In FIG. 18C, gripper arm support platforms 204 are shown in the lower position, i.e., upper rail 223 is below sharp chain 213 and lifting beam 246 is resting on beam support shoulder 254. Upon activation of actuator 250, gripper arm support platform 204 and upper rail 223 will be lifted by elevating assembly 240 as described above to the position seen in FIG. 18D. It can be seen that any board or other work piece centered on upper rails 223 by gripper arms 220 will be brought be into contact with sharp chain 213 when support platform 204 is in the lower position (FIG. 18C) and lifted out of contact with sharp chain 213 when support platform 204 is elevated (FIG. 18D).

Figure 19A:
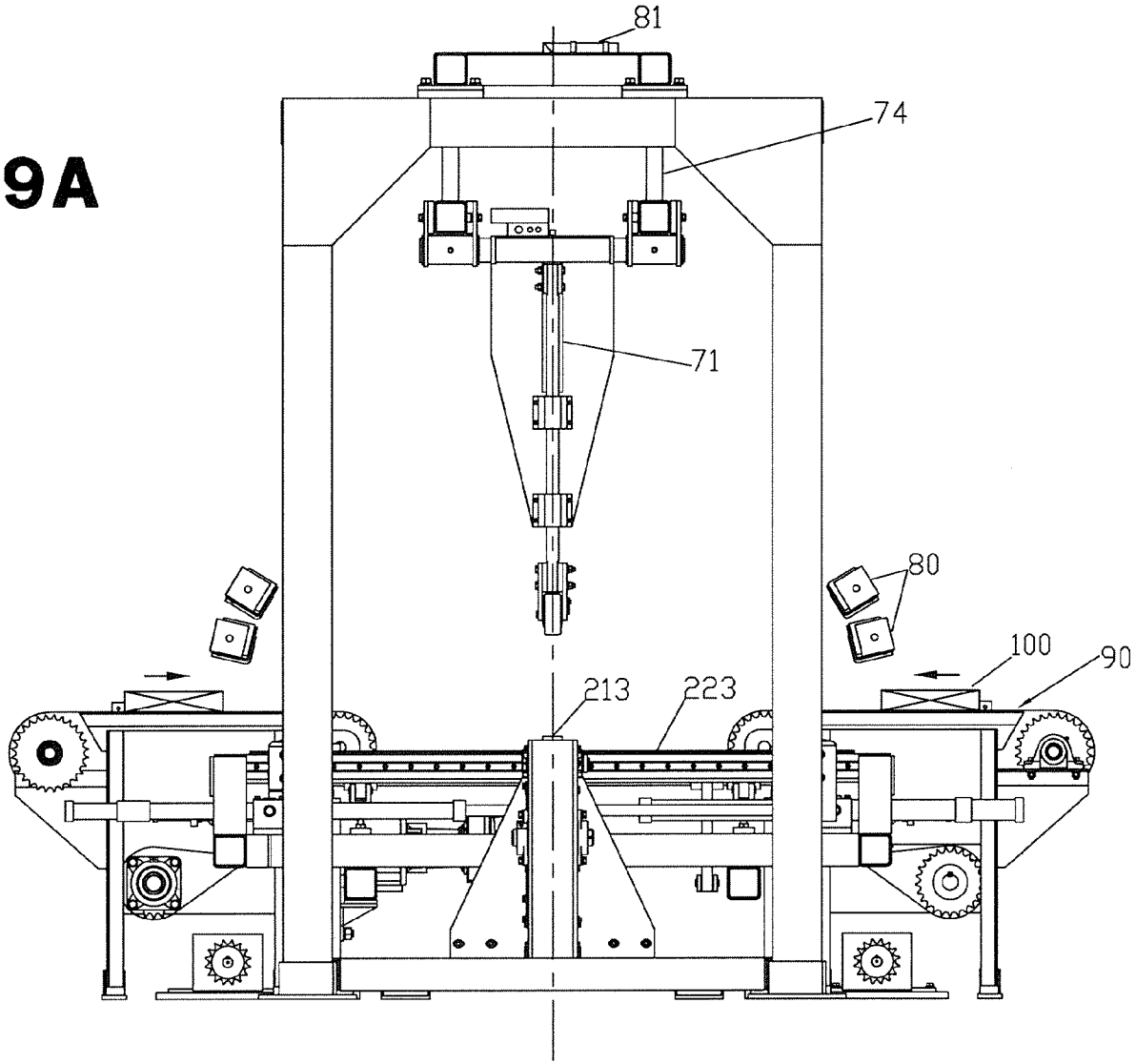
FIGS. 19A to 19F illustrates a sequence of board handle steps carried out by the embodiment seen in FIG. 14.
Figure 19B:
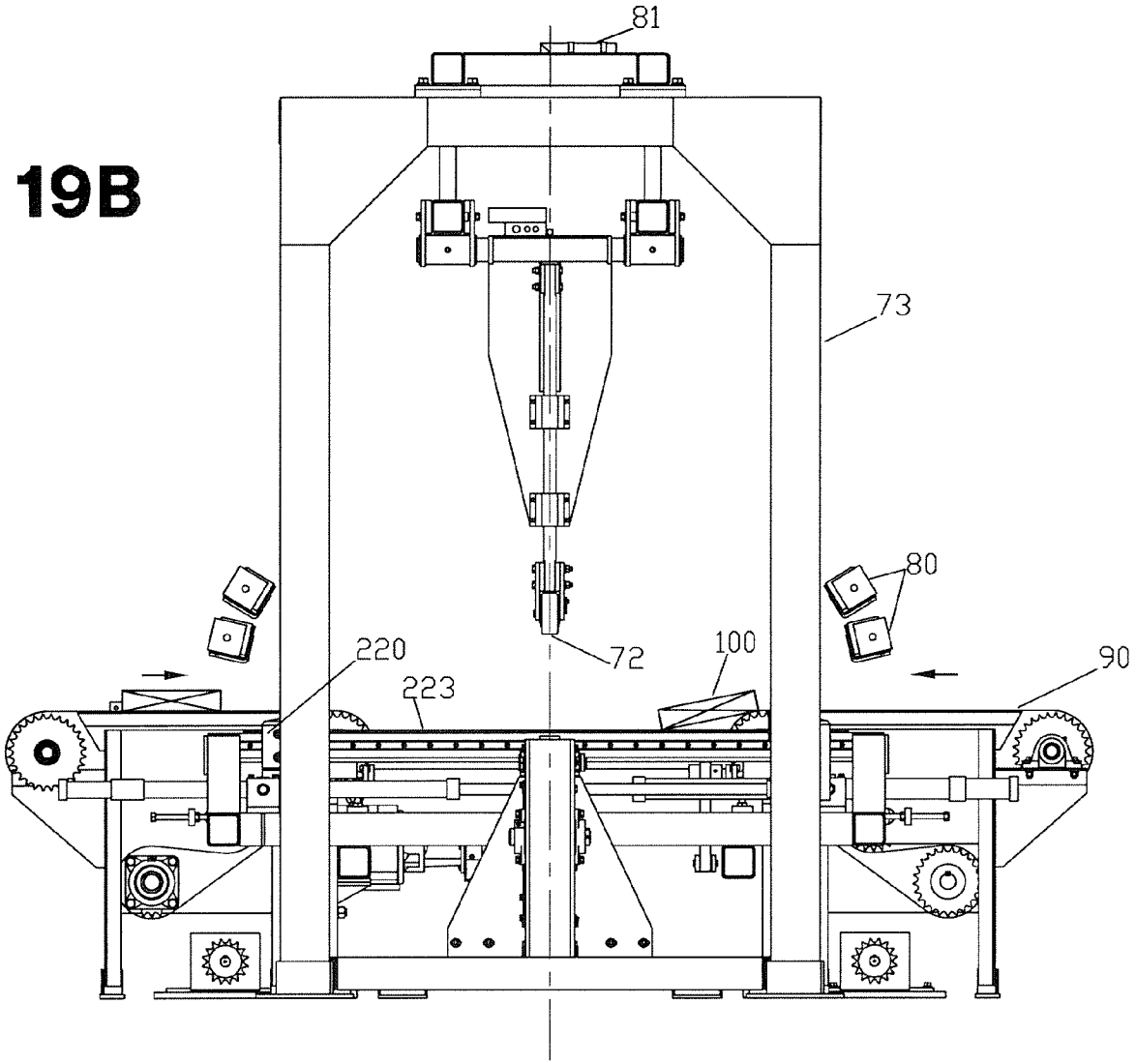
Figure 19C:
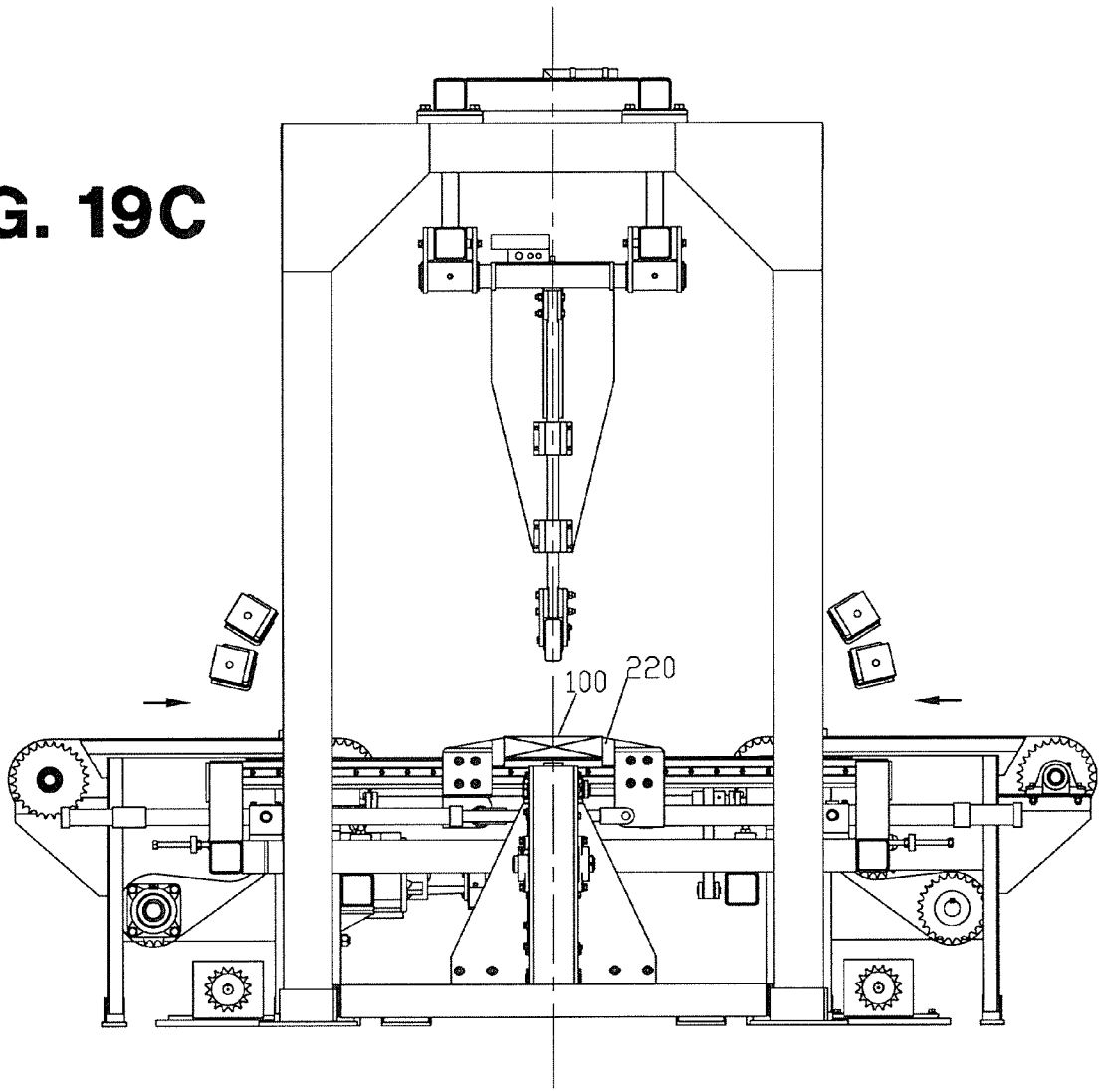
Figure 21:
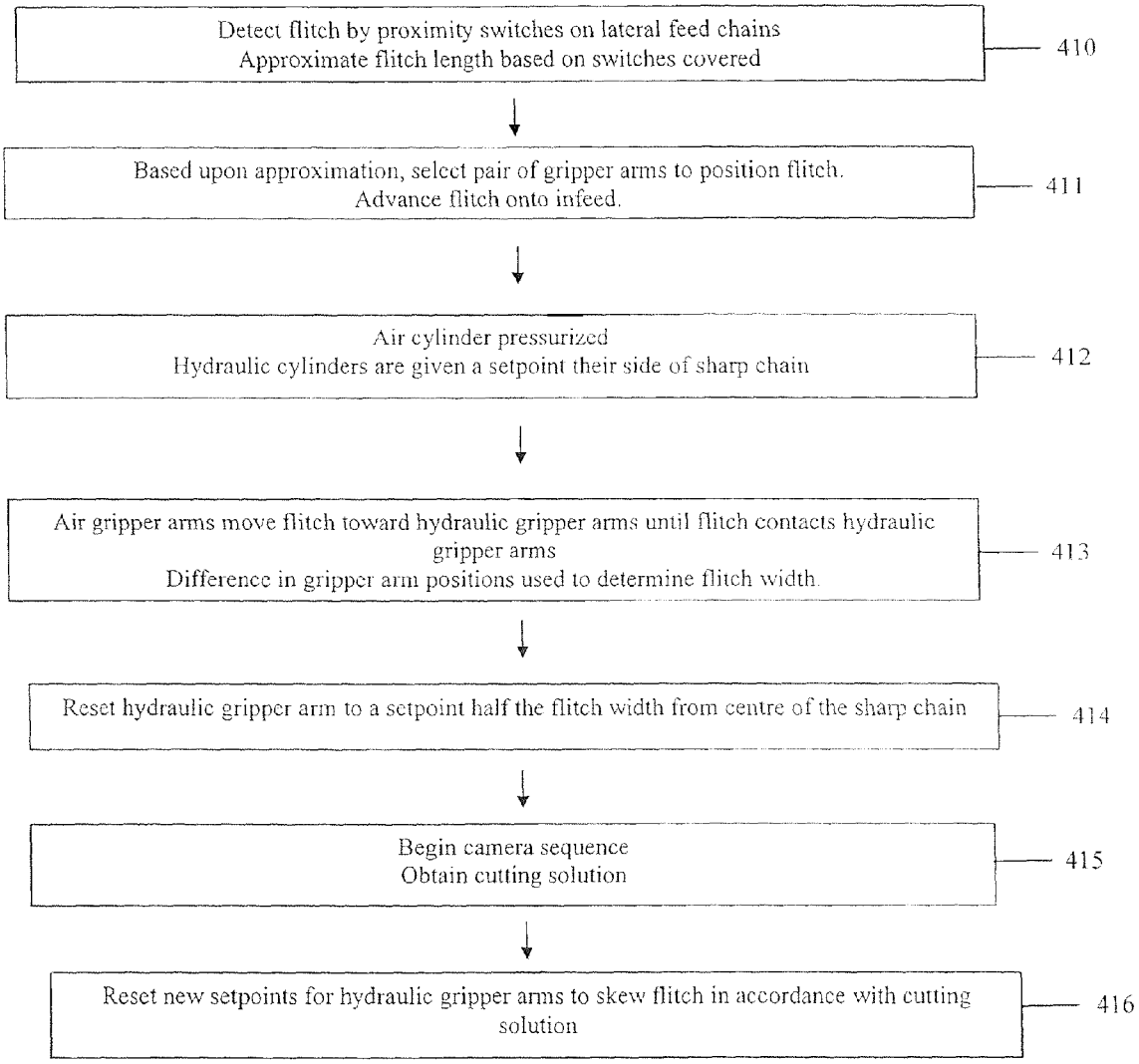
FIG. 21 is a flow chart illustrating steps carried out in FIGS. 19A to 19F.

FIGS. 19A to 19F illustrate the operation of board handling apparatus 201, which is similar to the operation of the embodiment shown in FIGS. 7 to 11. FIG. 21 is a flow chart illustrating how the hydraulic cylinders assemblies 225*a* and the air cylinders assemblies 225*b* interact to position a flitch in FIGS. 19A to 19F. In FIG. 19A, flitch 100 is positioned on lateral feed assembly 90 and is progressing toward upper rail 223 where it is transferred to upper rail 223 as seen in FIG. 19B. FIG. 19A shows a flitch on both the right and left lateral feed assemblies 90 in order to illustrate that flitches may be fed from either side of the handling apparatus. Of course, only one flitch at a time would be positioned over sharp chain 213. In FIG. 19B, gripper arms 220 are largely hidden from view behind overhead frame 73. In the corresponding step 410 of FIG. 21, the flitch is transferred to the chains of the lateral feed assembly 90. The proximity switches associated with each of the lateral feed chains will detect the flitch and an approximate length of the flitch may be calculated based on which proximity switches are triggered. In step 411, the length information obtained in step 410 allows selection of the two sets of gripper arms closest to the ends of the flitch, but which can still grip the flitch. Then the lateral feed chains advance the flitch to a position where the gripper arms can engage the flitch (see FIG. 19B). Once flitch 100 is on upper rail 223, in step 412, the air cylinder assemblies 225*b* are pressurized and cause the gripper arms associated therewith ("air gripper arms") to move toward sharp chain 312. The gripper arm associated with hydraulic cylinder assemblies 225*a* ("hydraulic gripper arms") are given an initial setpoint on their side of sharp chain 312. In step 413 (assuming the flitch is loaded on the side of the sharp chain having the air gripper arms), the air gripper arms move the flitch toward the hydraulic gripper arms until the flitch contacts the hydraulic gripper arms (FIG. 19C).

The air pressure in air cylinder assemblies 225*b* is maintained at a level sufficient to move air gripper arms and the flitch, but not at a level so high that the air gripper arms tend to damage the flitch when pressing it against the hydraulic arms. When the position of the air gripper arms cease moving, it is presumed that the flitch has contacted the hydraulic gripper arms. Using the relative positions of the hydraulic and air gripper arms (as measured with the linear transducers), the width of the flitch can be calculated between each pair of gripper arms. In order to center the flitch over the sharp chain, step 414 resets the hydraulic gripper arms' setpoint to half the width of the flitch from the center of the sharp chain. It will be understood that because the fluid in air cylinder assemblies 225*b* is compressible, the air gripper arms will follow the hydraulic gripper arms, but continually press against the flitch and keep it firmly secured between the air and hydraulic gripper arms. In step 415, the cameras take the sequence of images needed for the optimizing software to obtain a cutting solution and then the software calculates and returns the cutting solution. In step 416, the hydraulic gripper arms receive new setpoints which correspond to the cutting solution.

The methods for orientating the flitch may be one of those described above or any other method suitable for accomplishing the flitch shaping objectives desired. Typically, flitch 100 will be gripped by two or more pairs of gripper arms 220, but there may be situations where proper orientation may be accomplished with only one pair of gripper arms 220. In other situations, both (or more) pairs of gripper arms 220 will be adjusted in order to obtain the proper orientation of the flitch. In the embodiment shown, each pair of grippers 220 may move independently on their respective support platforms 204 either to the left or right (from the perspective seen in FIG. 19C) to achieve a desired orientation Achieving proper orientation of the flitch does not necessarily require position adjustment of all pairs of gripper arms holding the flitch has been gripped over sharp chain 213. In some situations, it may be sufficient for only one pair of gripper arms to make a slight left or right adjustment to properly orient the flitch.

Figure 19D:
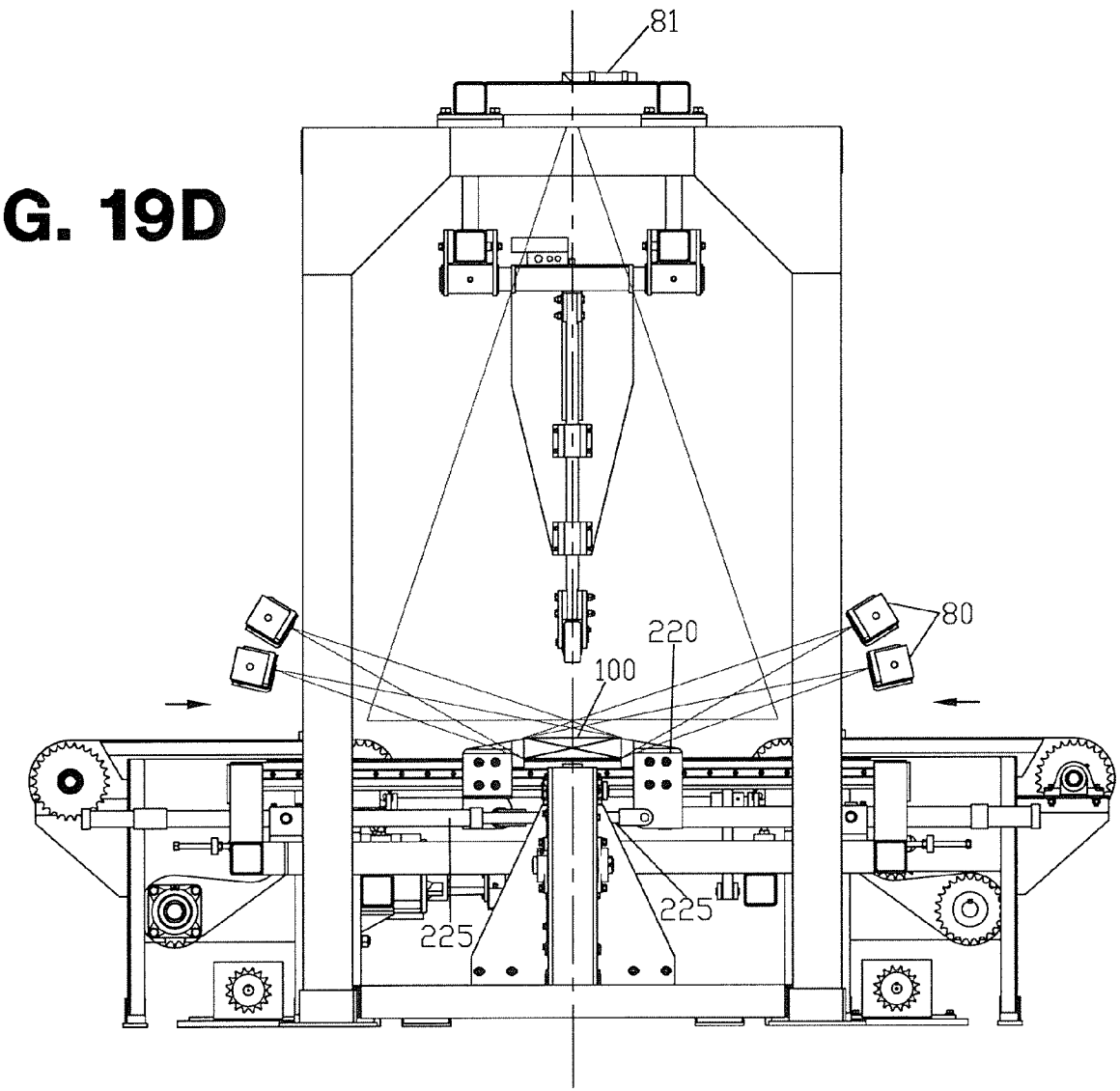
Figure 19E:
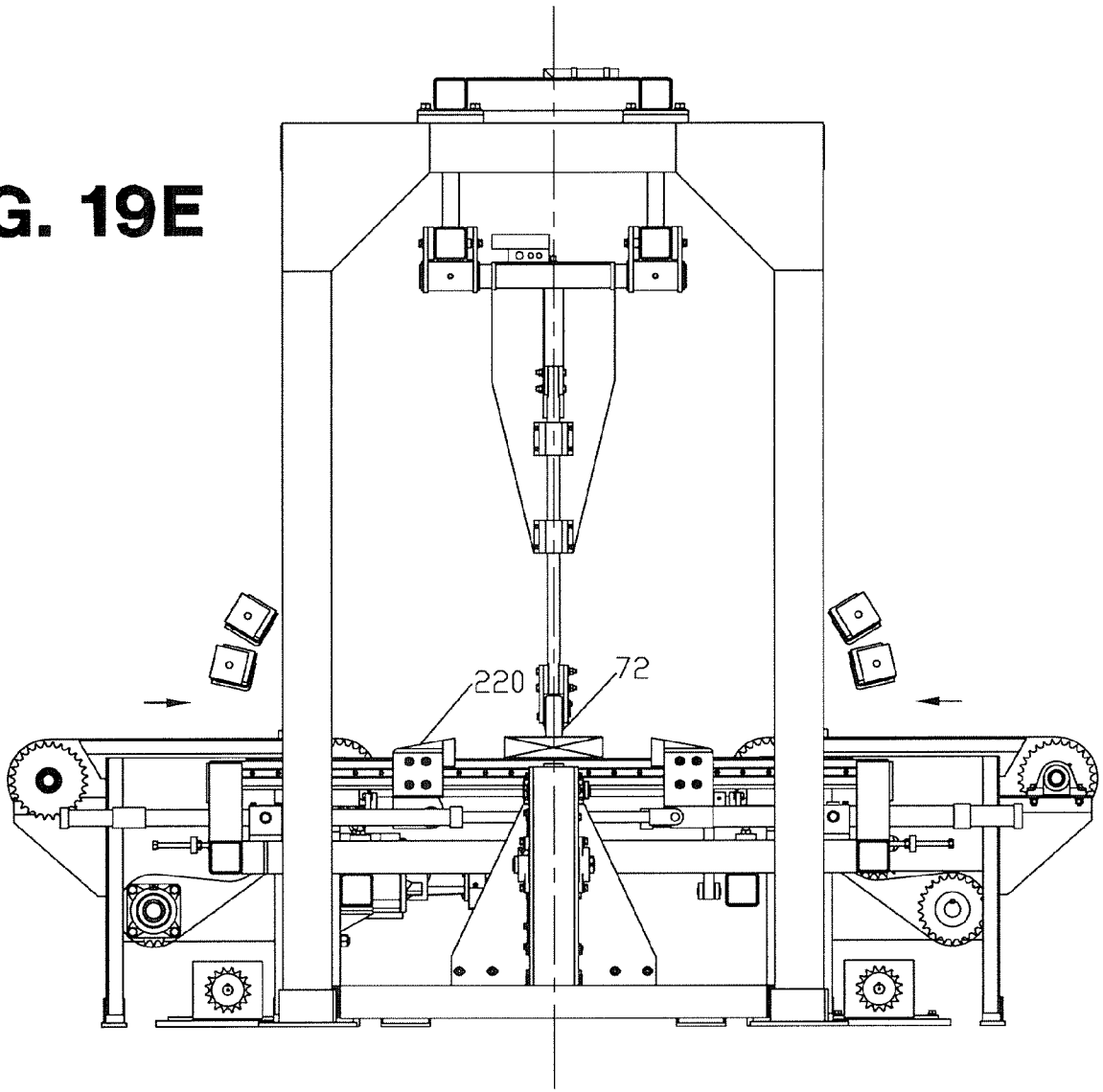
Figure 19F:
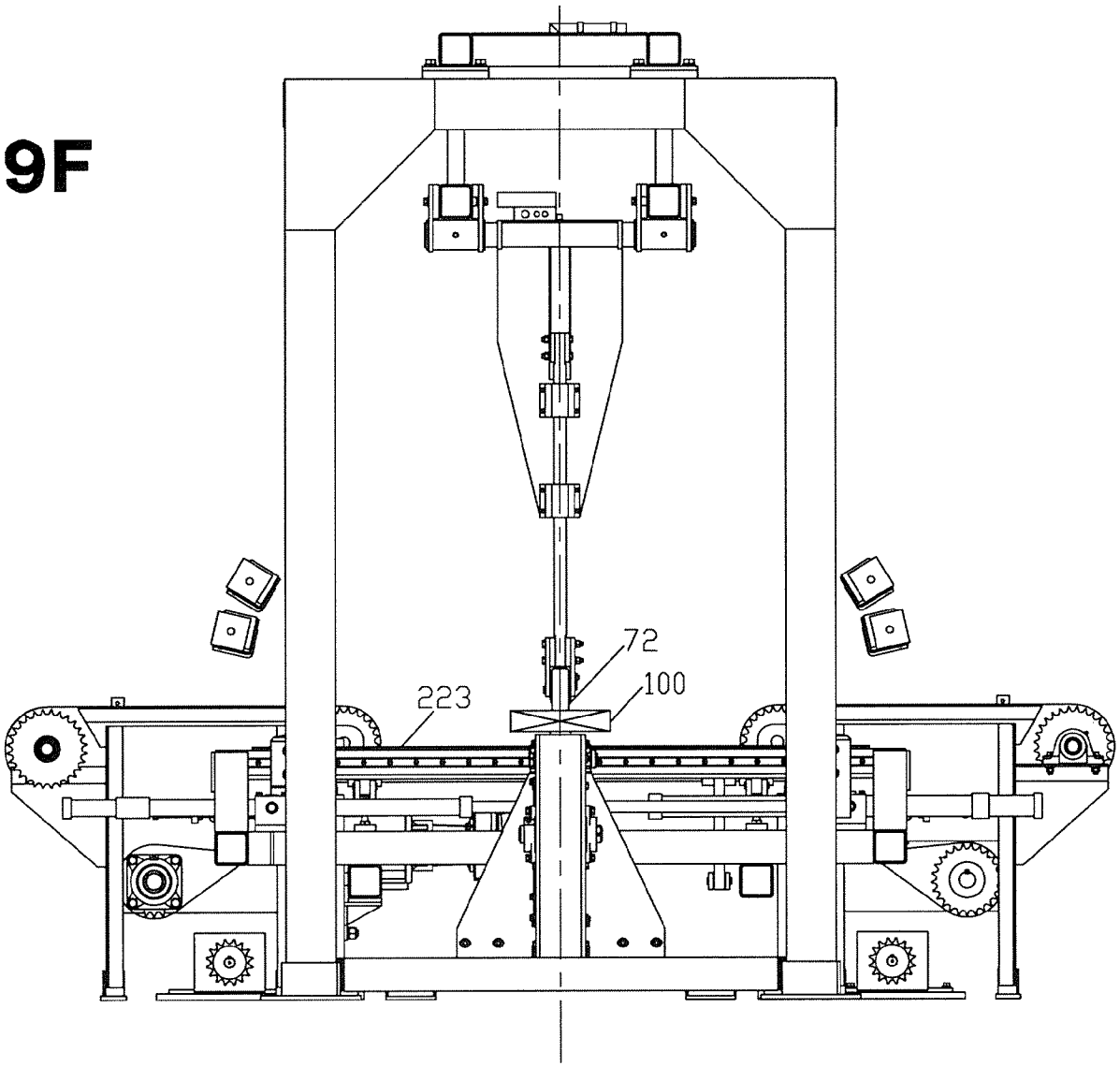

Once the flitch 100 has been repositioned to the desired orientation, the means for holding flitch 100 will transition from gripper arms 220 and upper rail 223 to hold down assembly 70 and sharp chain 213 as suggested by FIGS. 19E and 19F. Upper rails 223 and the piston arm of hold down cylinder 71 are lowered until flitch 100 is resting on sharp chain 213 and held firmly in place by hold down roller 72. Because gripper arms 220 are still in position at this point, the orientation of flitch 100 is not altered. Once flitch 100 is firmly gripped by hold down roller 72 and sharp chain 213, gripper arms 220 release and move away from flitch 100.

Although the two illustrated embodiments show the gripper arms adjusting the orientation of the flitch while the flitch is not touching the sharp chain, other embodiments could allow the flitch to rest lightly on the sharp chain while the orientation step is taking place. The flitch should not be considered "engaging" the longitudinal transport assembly if the flitch may be positioned with the gripper arms (even if the flitch is touching the sharp chain). Rather, the flitch engages the longitudinal transport assembly when the flitch is pressed securely against the sharp chain such that the flitch can no longer freely change its position.

As suggested in FIG. 19D, this embodiment may employ a similar series of lights 80 and overhead cameras 81 positioned on overhead frame 73 as seen in the previous embodiment. Likewise, the sawing station 105 could be equipped with similar projecting visible (e.g., red) laser beam lines down the length of sharp chain 213 as described above in order to indicate the position of opposing saw blades in sawing station 105.

Figure 20:
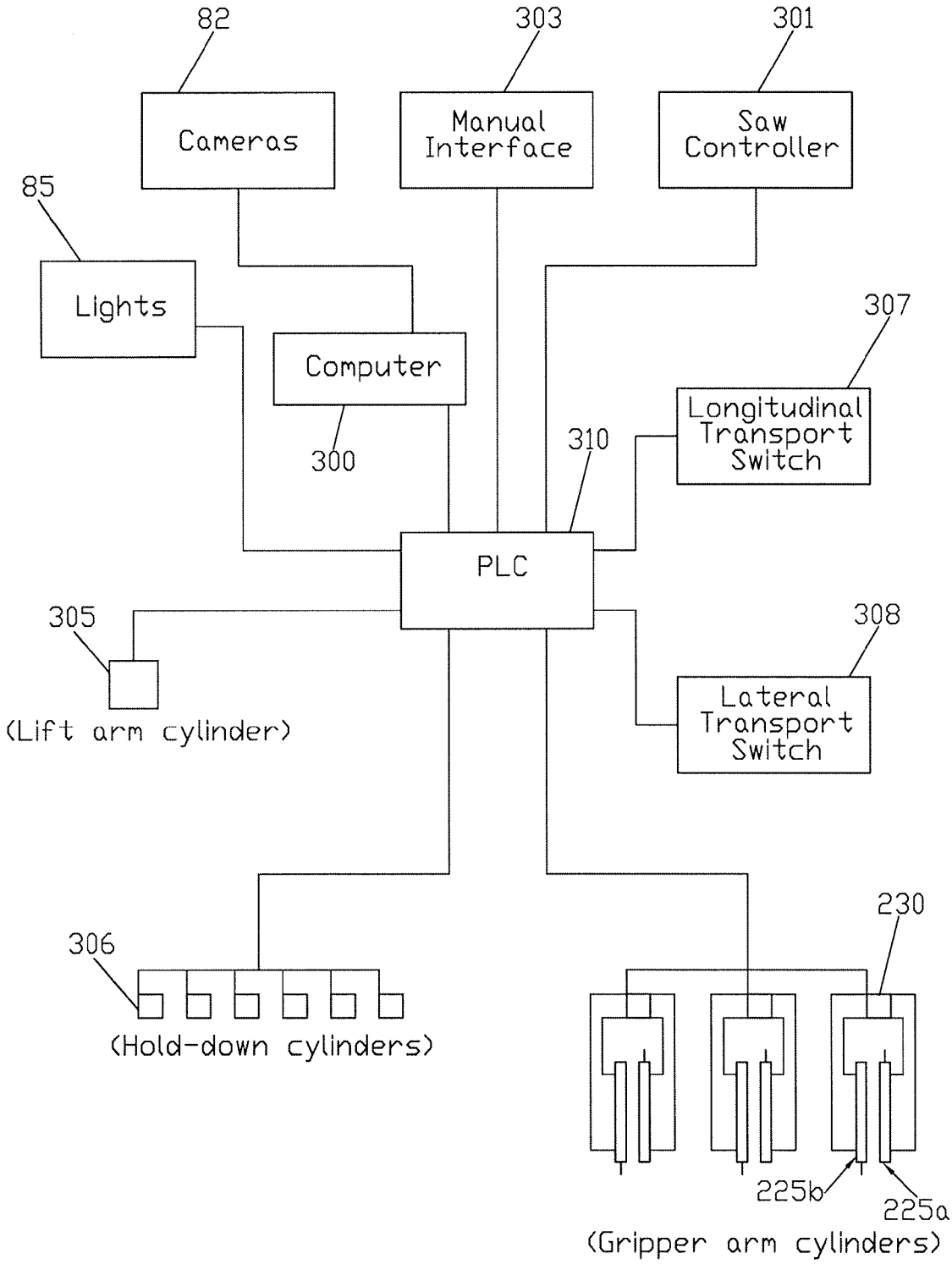
FIG. 20 a schematic of the control system of the embodiment seen in FIG. 14.

FIG. 20 illustrates a schematic representation of one control system similar to that in FIG. 12, but modified to the embodiment of FIGS. 14-19. As in FIG. 12, a computer 300 will control the operation cameras 82, and communicate with PLC 310. PLC will operate controller 301, switches 307 and 308 which activate longitudinal transport assembly 203 and lateral transport assemblies 90, and activate the control valves which supply fluid to the various piston and cylinder assemblies. These include control valve 305 for actuation of platform elevating cylinder 251, control valves 306 for hold down cylinders 71, and control valves 230 for positioning piston and cylinder assemblies 225. In the example described above, control valves 230 would include solenoid valves for air cylinder assemblies 225*b* and hydraulic proportional valves for hydraulic cylinders 225*a*.

PLC 310 may receive inputs from a manual user interface 303 such as the operator joy stick described below. Alternatively, the orientation process may be fully automated using software such as the Infra Red Inline Scanner or IRIS™ by AE Automation Electronics of Mount Maunganui, New Zealand described above. Another suitable software package would be Crosby Compact Hardwood Edger Optimizer available from Crosby Sawmill Machines of Simsboro, La. In the embodiment using the IRIS™ software, the flitch can be photographed and a cutting solution calculated while the flitch remains stationary. The gripper arms then adjust based upon the cutting solution. This embodiment is less time consuming than prior art systems which require shifting of the flitch during the scanning process in order to obtain the dimensions of the flitch.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims. As one example, any of the piston and cylinder assemblies disclosed herein could be replaced by any type of linear actuator (e.g., power screws). Likewise, while not described in the illustrated embodiments, the present invention also encompasses methods other than camera imaging for obtaining dimensional information about flitch 100. For example, laser devices could map the surfaces of flitch 100 or any other existing or future developed system could be employed to obtain the dimensional information required to position flitch 100.

We claim:

1. A lumber handling apparatus comprising:

a. a base frame having a longitudinal transport assembly;

b. at least two gripper arm support platforms positioned on said base frame, said support platforms each including an upper rail;

c. at least two lifting beams supporting said gripper arm support platforms and at least one torque transfer rod connected to said lifting beams by pivoting linkages synchronizing the movement of said lifting beams and actuated by a linear actuator;

d. at least two gripper arms positioned on each of said support platforms;

e. a positioning assembly comprising an actuator controlling each of said gripper arms, thereby allowing said gripper arms to move toward said longitudinal transport assembly into a gripping position and away from said longitudinal transport assembly into a release position;

f. a platform elevating assembly, said platform elevating assembly selectively moving said upper rails above and below a level of said longitudinal transport assembly; and g. a hold-down assembly capable of securing an item of lumber against said longitudinal transport assembly when said gripping arms are in either a gripping position or a release position.

2. The lumber handling apparatus according to claim 1, wherein said gripper arms are mounted upon said upper rails.

3. The lumber handling apparatus according to claim 1, wherein said gripper arm positioning actuators are linear actuators.

4. The lumber handling apparatus according to claim 2, wherein said longitudinal transport assembly comprises a sharp chain mechanism.

5. The lumber handling apparatus according to claim 4, wherein said sharp chain travels in a circuitous path around at least one of said rails, approaching at a level approximates to said rail, extending beneath said rail, and rising again to a level approximate said rail.

6. The lumber handling apparatus according to claim 1, wherein a lateral feed assembly is positioned on at least one side of said apparatus.

7. The lumber handling apparatus according to claim 1, further comprising at least one camera having a field of view focused on at least a portion of said longitudinal transport assembly.

8. A lumber handling apparatus comprising:

a. a base frame having a longitudinal transport assembly;

b. at least two gripper arm support platforms positioned on said base frame, said support platforms each including an upper rail;

c. a first gripper arm and a second gripper arm on each gripper arm support platform;

d. a positioning assembly comprising a pneumatic piston and cylinder assembly positioning said first gripper arm and a hydraulic piston and cylinder assembly positioning said second gripper arm;

e. a positioning assembly comprising an actuator controlling each of said gripper arms, thereby allowing said gripper arms to move toward said longitudinal transport assembly into a gripping position and away from said longitudinal transport assembly into a release position;

f. a platform elevating assembly, said platform elevating assembly selectively moving said upper rails above and below a level of said longitudinal transport assembly; and g. a hold-down assembly capable of securing an item of lumber against said longitudinal transport assembly when said gripping arms are in either a gripping position or a release position.

9. A method of positioning a work piece in a given orientation comprising the steps of:

a. providing a handling apparatus comprising a base frame, a longitudinal transport assembly, and at least two gripper arm support platforms with a pair of gripper arms positioned on each of said two support platforms;

b. having said gripper arms grip said work piece over said longitudinal transport assembly;

c. making an image of said work piece and calculating a recommended orientation;

d. adjusting at least one of said gripper arms based upon said recommended orientation; and e. advancing said work piece with said longitudinal transport assembly while maintaining said recommended orientation; and g. wherein a first gripper arm of said pair is actuated by a pneumatic piston and cylinder assembly and a second gripper arm of said pair is actuated by a hydraulic piston and cylinder assembly, and wherein air supply to said pneumatic piston and cylinder assembly is substantially constant while said first gripper arm engages said work piece over said longitudinal transport assembly.

10. The method according to claim 9, wherein after said step of adjusting said gripper arms, said gripper arms release said work piece and a hold down assembly maintains said recommended orientation.

* * * * *